US009880510B2

(12) United States Patent
Toyama et al.

(10) Patent No.: US 9,880,510 B2
(45) Date of Patent: Jan. 30, 2018

(54) CLEANING BLADE, IMAGE FORMING APPARATUS, AND PROCESS CARTRIDGE

(71) Applicants: Kaori Toyama, Kanagawa (JP); Masanobu Gondoh, Kanagawa (JP); Yohta Sakon, Kanagawa (JP); Shohei Gohda, Ishikawa (JP); Yuka Aoyama, Kanagawa (JP); Yuta Nakamura, Kanagawa (JP)

(72) Inventors: Kaori Toyama, Kanagawa (JP); Masanobu Gondoh, Kanagawa (JP); Yohta Sakon, Kanagawa (JP); Shohei Gohda, Ishikawa (JP); Yuka Aoyama, Kanagawa (JP); Yuta Nakamura, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 15/095,654

(22) Filed: Apr. 11, 2016

(65) Prior Publication Data

US 2016/0320740 A1 Nov. 3, 2016

(30) Foreign Application Priority Data

May 1, 2015 (JP) ..... 2015-094424

(51) Int. Cl.
*G03G 21/00* (2006.01)

(52) U.S. Cl.
CPC ..... *G03G 21/0017* (2013.01)

(58) Field of Classification Search
CPC ..... G03G 21/0011; G03G 21/0017
USPC ..... 399/123, 350
See application file for complete search history.

(56) References Cited

U.S. PATENT DOCUMENTS

| | | | | |
|---|---|---|---|---|
| 6,060,205 | A | 5/2000 | Takeichi et al. | |
| 6,160,977 | A | 12/2000 | Takeichi et al. | |
| 8,897,690 | B2 | 11/2014 | Sakon et al. | |
| 8,913,944 | B2 | 12/2014 | Sakon et al. | |
| 9,031,491 | B2 | 5/2015 | Asano et al. | |
| 2008/0219694 | A1 | 9/2008 | Nakamori et al. | |
| 2009/0311017 | A1 | 12/2009 | Ohmori et al. | |
| 2014/0178103 | A1 | 6/2014 | Gohda et al. | |
| 2014/0341629 | A1* | 11/2014 | Watanabe | G03G 21/0017 399/350 |
| 2015/0212479 | A1* | 7/2015 | Toyama | B05D 3/067 399/350 |
| 2015/0253722 | A1 | 9/2015 | Sakaguchi et al. | |
| 2015/0261170 | A1* | 9/2015 | Nakamura | G03G 21/0017 399/350 |

FOREIGN PATENT DOCUMENTS

| | | |
|---|---|---|
| JP | 2010-152295 | 7/2010 |
| JP | 2014-142597 | 8/2014 |

* cited by examiner

*Primary Examiner* — David M Gray
*Assistant Examiner* — Andrew V Do
(74) *Attorney, Agent, or Firm* — Oblon, McClelland, Maier & Neustadt, L.L.P.

(57) ABSTRACT

Provided is a cleaning blade including an elastic member, wherein a spin-spin relaxation time ($T_2$) of the elastic member obtained by a solid echo method in a pulse NMR analysis is longer than or equal to 0.60 msec but shorter than or equal to 1.0 msec, and wherein the elastic member has a contact part to contact a surface of a cleaning target member, and the contact part contains a cured product of a curable composition.

18 Claims, 5 Drawing Sheets

CLEANING BLADE, IMAGE FORMING APPARATUS, AND PROCESS CARTRIDGE

CROSS-REFERENCE TO RELATED APPLICATIONS

The present application claims priority under 35 U.S.C. § 119 to Japanese Patent Application No. 2015-094424, filed May 1, 2015. The contents of which are incorporated herein by reference in their entirety.

BACKGROUND OF THE INVENTION

Field of the Invention

The present disclosure relates to cleaning blades, image forming apparatuses, and process cartridges.

Description of the Related Art

Hitherto, electrophotographic image forming apparatuses transfer a toner image formed over an image bearer (hereinafter may also be referred to as "photoconductor", "electrophotographic photoconductor", or "electrostatic latent image bearer") onto a recording medium or the like and then remove any unnecessary toner and other unnecessary matters (residues) remaining over the surface of the image bearer with a cleaning unit. Cleaning blades including a flat-plate-shaped elastic member made of, for example, a polyurethane rubber and a supporting member to which one end of the elastic member is secured are often used as the cleaning unit because cleaning blades can achieve an excellent cleaning performance with a simple configuration.

When a polymerization toner formed by a polymerization method or the like and having a small particle diameter and a nearly spherical shape is used instead of a typical pulverization toner in order to meet a recent need for a higher image quality, a cleaning failure may occur because the polymerization toner slips through a slight gap formed between the elastic member and the image bearer. When a contact part at which the elastic member contacts the image bearer at a free end side of the elastic member is brought into contact with the image bearer with a high pressure in order to suppress the cleaning failure, a high friction develops between the contact part and the image bearer to cause the contact part to curl, leading to a problem that a local crack (local wear) is likely to occur in an end surface of the elastic member at the free end side of the elastic member.

To overcome this problem, the present applicant has already proposed a cleaning blade in which a contact part of an elastic member made of a polyurethane rubber is impregnated with a curable composition such that the contact part can be prevented from curling (see, e.g., Japanese Unexamined Patent Application Publication No. 2014-142597).

Because the cleaning blade wears with time, in order for the cleaning blade to sustain the function only by means of the impregnation of the contact part of the elastic member with the curable composition as proposed, there is a need for reformation of the contact part by subjecting the contact part to impregnation for a long time to let the curable composition impregnate more inward to increase an impregnated region. However, through a long impregnation treatment, the elastic member undergoes a large swell with a solvent so that a deformation such as rolling occurs at the contact part and the cleaning blade will have an uneven contact with the image bearer, leading to a problem that a cleaning failure may occur.

SUMMARY OF THE INVENTION

Provided is a cleaning blade including an elastic member. A spin-spin relaxation time ($T_2$) of the elastic member obtained by a solid echo method in a pulse NMR analysis is longer than or equal to 0.60 msec but shorter than or equal to 1.0 msec. A contact part of the elastic member to contact a surface of a cleaning target member contains a cured product of a curable composition.

DETAILED DESCRIPTION OF THE INVENTION

Figure 1:
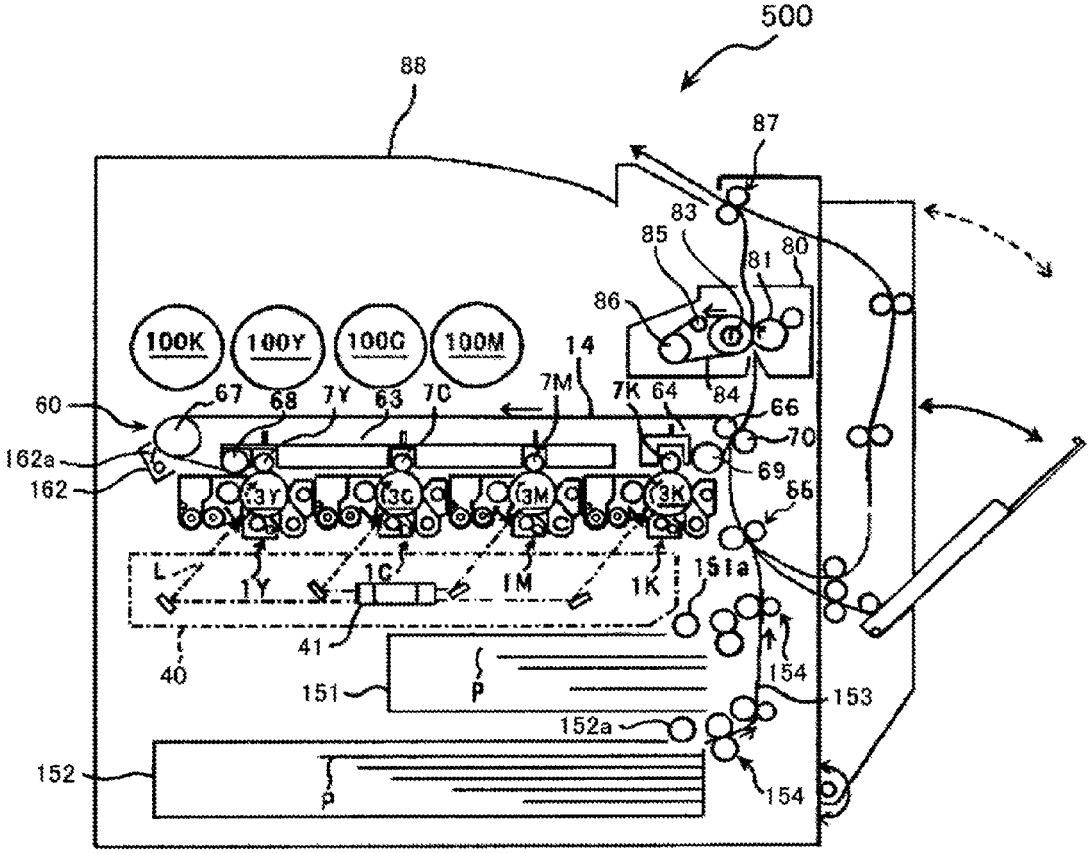
FIG. 1 is a schematic cross-sectional view illustrating an image forming apparatus according to an embodiment of the present invention.

The present invention has an object to provide a cleaning blade suppressed in curling and rolling of a contact part of an elastic member of the cleaning blade, capable of preventing occurrence of an uneven contact with a cleaning target member, and capable of realizing a favorable cleaning performance for a long term.

The present invention can provide a cleaning blade suppressed in curling and rolling of a contact part of an elastic member of the cleaning blade, capable of preventing occurrence of an uneven contact with a cleaning target member, and capable of realizing a favorable cleaning performance for a long term.

(Cleaning Blade)

A cleaning blade of the present invention includes an elastic member, preferably includes a supporting member, and further includes other members as needed.

In the present invention, a spin-spin relaxation time ($T_2$) of the elastic member is longer than or equal to 0.60 msec but shorter than or equal to 1.0 msec. When the spin-spin relaxation time ($T_2$) is longer than or equal to 0.60 msec but shorter than or equal to 1.0 msec, the elastic member has a low tackiness and can be impregnated with a curable composition to an internal region of the elastic member in a short time. This provides an advantage that curling and rolling of the contact part are less likely to occur.

The spin-spin relaxation time ($T_2$) obtained by a solid echo method in the pulse NMR analysis is a parameter indicating, from an aspect of molecular mobility, a hardness of the entire elastic member obtained. When the spin-spin relaxation time ($T_2$) is short, molecular mobility is low and the elastic member has a high hardness. On the other hand, when the spin-spin relaxation time ($T_2$) is long, molecular mobility is high and the elastic member obtained has a low hardness and is soft. Hence, the spin-spin relaxation time ($T_2$) of longer than or equal to 0.60 msec but shorter than or equal to 1.0 msec is advantageous because the spin-spin relaxation time ($T_2$) in this range provides the elastic member with a low tackiness and makes it possible to impregnate the elastic member with a curable composition to an internal region of the elastic member in a short time and suppress occurrence of curling and rolling of the contact part.

The spin-spin relaxation time ($T_2$) can be obtained by a solid echo method in a pulse NMR analysis.

The pulse NMR analysis can be conducted according to a method described below.

The spin-spin relaxation time ($T_2$) can be evaluated with "MINISPEC-MQ20" available from Bruker Optics K.K. A time taken for an x-component and a y-component of a magnetization vector of the elastic member to vanish (i.e., a relaxation time) when the magnetization vector is tipped by application of a high-frequency magnetic field as a pulse to the elastic member put in an NMR tube can be used to evaluate the mobility of molecules constituting the elastic member. A detailed measuring method and measuring conditions are presented below.

A decay curve of an observed nucleus 1H is measured with "MINISPEC-MQ20" available from Bruker Optics K.K. according to a solid echo method. The elastic member is cut into a sample having a size of 8 mm×8 mm×1.8 mm and the sample is put in a dedicated sample tube. The sample tube is inserted into an appropriate range of a magnetic field and the measurement can be performed under the conditions described below.

[Detailed Measuring Conditions]

First Duration: 0.01 msec

Last Duration: 5.0 msec

Data Point: 20

Cumulated Number: 32

Temperature: 40° C.

The cleaning blade is not particularly limited and may be appropriately selected depending on the intended purpose. However, it is preferable that the cleaning blade include a supporting member and an elastic member having a portion of the elastic member secured to the supporting member and having a free end.

The cleaning blade is configured to have either one of longer sides of an end surface of the elastic member at the free end contact a surface of a cleaning target member to scrape off and remove a toner, etc. remaining over the surface of the cleaning target member.

Here, the either one of the longer sides of the end surface of the elastic member at the free end is referred to as a contact side. Due to deformation and wear of the contact side accompanying contacts of the contact side with the surface of the cleaning target member, not only the contact side but also a plate surface including the contact side and the end surface at the free end come to contact the surface of the cleaning target member. Therefore, such a portion of the plate surface including the contact side as adjacent to the contact side and such a portion of the end surface at the free end as adjacent to the contact side are referred to as a contact part.

<Elastic Member>

The elastic member may be of any shape, any size, any material, and any structure that may be appropriately selected depending on the intended purpose.

The shape of the elastic member is not particularly limited and may be appropriately selected depending on the intended purpose. Examples of the shape include a shape having a pair of plate surfaces facing each other in a direction of a thickness of the elastic member and two pairs of end surfaces crossing the plate surfaces at a right angle and facing the paired surfaces in in-plane directions of the plate surfaces. Preferable examples of the shape include a flat plate shape, a strip shape, and a sheet shape.

An average thickness of the elastic member is not particularly limited and may be appropriately selected depending on the intended purpose. However, the average thickness is preferably greater than or equal to 1.0 mm but less than or equal to 3.0 mm.

Examples of a method for measuring the average thickness include a method for selecting a plurality of arbitrary points of the elastic member and calculating an average of the thicknesses at the plurality of points. The average is preferably an average of thicknesses of 5 points, more preferably an average of thicknesses of 10 points, and particularly preferably an average of thicknesses of 20 points. An average thickness of any other layer can also be calculated in the same manner. Examples of an instrument for measuring the average thickness include a micrometer.

The size of the elastic member is not particularly limited and may be appropriately selected depending on the size of the cleaning target member.

The material of the elastic member is not particularly limited and may be appropriately selected depending on the intended purpose. However, a rubber, an elastomer, and the like are preferable because a high elasticity can be obtained easily.

Examples of the rubber include polyurethane rubbers. Examples of the elastomer include polyurethane elastomers. Of these, polyurethane rubbers are more preferable.

The polyurethane rubbers are not particularly limited and may be appropriately selected depending on the intended purpose. For example, the polyurethane rubbers are produced by preparing a polyurethane prepolymer from a polyol compound and a polyisocyanate compound, adding a curing agent, a cross-linking agent, a chain extender, and as needed, a curing catalyst to the polyurethane prepolymer, cross-linking the resultant in a predetermined mold, post-cross-linking the resultant in a furnace, centrifugally casting the resultant into a sheet shape, leaving the resultant standing at normal temperature for aging, and cutting the resultant into a flat plate shape having predetermined dimensions.

The polyol compound is not particularly limited and may be appropriately selected depending on the intended purpose. Examples of the polyol compound include a high-molecular-weight polyol and a low-molecular-weight polyol.

Examples of the high-molecular-weight polyol include a polyester-based polyol, a polycaprolactone-based polyol, and a polyether-based polyol. The polyester-based polyol is a condensate of an alkylene glycol and an aliphatic dibasic acid. Examples of the alkylene glycol include ethylene adipate ester polyol, butylene adipate ester polyol, hexylene adipate ester polyol, ethylene propylene adipate ester polyol, ethylene butylene adipate ester polyol, and ethylene neopentylene adipate ester polyol. Examples of the aliphatic dibasic acid include an adipic acid. Examples of the polycaprolactone-based polyol include polycaprolactone ester polyol and polycaprolactone ester diol that are obtained by ring-opening polymerization of caprolactone. Examples of the polyether-based polyol include poly(oxytetramethylene) glycol and poly(oxypropylene)glycol. One of these may be used alone or two or more of these may be used in combination.

Examples of the low-molecular-weight polyol include a divalent alcohol and a trivalent or higher polyvalent alcohol. Examples of the divalent alcohol include 1,4-butanediol, ethylene glycol, neopentyl glycol, hydroquinone-bis(2-hydroxyethyl)ether, 3,3'-dichloro-4,4'-diaminodiphenylmethane, and 4,4'-diaminodiphenylmethane. Examples of the trivalent or higher polyvalent alcohol include 1,1,1-trimethylolpropane, glycerin, 1,2,6-hexanetriol, 1,2,4-butanetriol, trimethylolethane, 1,1,1-tris(hydroxyethoxymethyl)propane, diglycerin, and pentaerythritol. One of these may be used alone or two or more of these may be used in combination.

The polyisocyanate compound is not particularly limited and may be appropriately selected depending on the intended purpose. Examples of the polyisocyanate compound include methylenediphenyldiisocyanate (MDI), polymeric MDI (p-MDI), tolylenediisocyanate (TDI), xylylenediisocyanate (XDI), naphthylene 1,5-diisocyanate (NDI), tetramethylxylenediisocyanate (TMXDI), isophoronediisocyanate (IPDI), hydrogenated xylylenediisocyanate (H6XDI), dicyclohexylmethanediisocyanate (H12MDI), hexamethylenediisocyanate (HDI), dimer acid diisocyanate (DDI), norbornenediisocyanate (NBDI), and trimethylhexamethylenediisocyanate (TMDI). One of these may be used alone or two or more of these may be used in combination.

The cross-linking agent is not particularly limited and may be appropriately selected depending on the intended purpose. Examples of the cross-linking agent include trimethylol propane.

The chain extender is not particularly limited and may be appropriately selected depending on the intended purpose. Examples of the chain extender include 1,4-butanediol.

The curing catalyst is not particularly limited and may be appropriately selected depending on the intended purpose. Examples of the curing catalyst include 2-methyl imidazole and 1,2-dimethyl imidazole.

A content of the curing catalyst is not particularly limited and may be appropriately selected depending on the intended purpose. However, the content is preferably greater than or equal to 0.01% by mass but less than or equal to 0.5% by mass and more preferably greater than or equal to 0.05% by mass but less than or equal to 0.3% by mass.

—JIS-A Hardness—

A JIS-A hardness of the elastic member is not particularly limited and may be appropriately selected depending on the intended purpose. However, the JIS-A hardness is preferably greater than or equal to 60 degrees and more preferably in a range of from 65 degrees through 80 degrees. When the JIS-A hardness is greater than or equal to 60 degrees, the elastic member is hard and less likely to have an increase in an area over which the elastic member contacts the image bearer. This makes a contact pressure (linear pressure) to be applied to the contact part high and makes it likely to obtain a predetermined edge biting amount, leading to a favorable cleaning property.

The linear pressure refers to a value obtained by dividing a force applied by the contact part against the image bearer by a length by which the contact part contacts the image bearer.

The JIS-A hardness can be measured according to a JIS K6253 standard using, for example, a micro rubber hardness meter (product name: MD-1 available from Kobunshi Keiki Co., Ltd.).

—Impact Resilience—

An impact resilience of the elastic member is not particularly limited and may be appropriately selected depending on the intended purpose. However, in terms of tackiness, the impact resilience is preferably lower than or equal to 80% and more preferably in a range of from 20% through 30% at 23° C. The impact resilience coefficient of the elastic member can be measured according to a JIS K6255 standard using, for example, a tripso-type impact resilience tester (product name: RESILIENCE TESTER available from Toyo Seiki Seisaku-Sho, Ltd.) under a measuring environment of 23° C.

The contact part of the elastic member contains a cured product of the curable composition.

In order to make the contact part of the elastic member contain the cured product of the curable composition, for example, first, the contact part is swelled with a below-described solvent contained in the curable composition, and at the same time, is permeated and impregnated with the curable composition. Next, the curable composition having impregnated the contact part is cured with a treatment such as ultraviolet irradiation and heating, and at the same time, the solvent with which the contact part has been swelled is vaporized. This results in a structure in which the cross-linked structure of the elastic member and the cured product of the curable composition are entwined with each other. Therefore, it is possible to make the cured product of the curable composition be contained in the elastic member in a state that the cured product hardly peels from the elastic member.

When it is said that "the contact part contains the cured product of the curable composition", it is meant that the cured product is contained not only over the surface of the contact part but also inside the contact part. This includes a case where the cured product is contained inside the contact part and also forms a surface layer over the contact part.

So long as the cured product of the curable composition is contained at least in the contact part of the elastic member, it does not matter if the cured product of the curable composition is contained in any other portion of the elastic member than the contact part.

<<Curable Composition>>

The curable composition is preferably an ultraviolet-curable composition.

The ultraviolet-curable composition preferably contains a (meth)acrylate compound having an alicyclic structure containing 6 or more carbon atoms in a molecule, more preferably contains a fluorine-group-containing compound, and further contains other components as needed.

—(Meth)acrylate Compound Having Alicyclic Structure Containing 6 or More Carbon Atoms in Molecule—

The (meth)acrylate compound having an alicyclic structure containing 6 or more carbon atoms in a molecule is not particularly limited and may be appropriately selected depending on the intended purpose. However, the number of carbon atoms is preferably greater than or equal to 6 but less than or equal to 12 and more preferably greater than or equal to 8 but less than or equal to 10. When the number of carbon atoms in the (meth)acrylate compound having an alicyclic structure containing 6 or more carbon atoms in a molecule is greater than or equal to 6 but less than or equal to 12, the contact part can be suppressed from cracking or peeling at the surface under a stress applied to the contact part due to a contact pressure and can be suppressed from local wear due to these factors.

The (meth)acrylate compound having an alicyclic structure containing 6 or more carbon atoms in a molecule is a (meth)acrylate compound having few functional groups and a low molecular weight because of the presence of a particular kind of a bulky alicyclic structure in the molecule. Therefore, the elastic member can be easily impregnated with the (meth)acrylate compound having an alicyclic structure containing greater 6 or more carbon atoms in a molecule. This efficiently provides a high hardness to the contact part.

The number of the functional groups is not particularly limited and may be appropriately selected depending on the intended purpose. However, the number of the functional groups is preferably greater than or equal to 2 but less than or equal to 6 and more preferably greater than or equal to 2 but less than or equal to 4. When the number of the functional groups is greater than or equal to 2 but less than or equal to 6, the contact part is less likely to have a poor hardness and there is also an advantage that the possibility of occurrence of steric hindrance can be reduced.

The structure of the (meth)acrylate compound having an alicyclic structure containing 6 or more carbon atoms in a molecule is not particularly limited and may be appropriately selected depending on the intended purpose. However, at least one kind selected from the group consisting of (meth)acrylate compounds each having a tricyclodecane structure and (meth)acrylate compounds each having an adamantane structure is preferable because these structures can compensate for insufficiency of cross-linking points with the particular kind of the cyclic structure even if the number of the functional groups is small.

Examples of the (meth)acrylate compounds each having a tricyclodecane structure include tricyclodecanedimethanol diacrylate and tricyclodecanedimethanol dimethacrylate. The (meth)acrylate compounds each having a tricyclodecane structure may be an appropriately synthesized product or a commercially available product. Examples of the commercially available product include product name: A-DCP (available from Shin-Nakamura Chemical Co., Ltd.).

Examples of the (meth)acrylate compounds each having an adamantane structure include 1,3-adamantanedimethanol diacrylate, 1,3-adamantanedimethanol dimethacrylate, 1,3,5-adamantanetrimethanol triacrylate, 1,3,5-adamantanetrimethanol trimethacrylate, and perfluoro-1,3-adamantanediol dimethacrylate. The (meth)acrylate compounds each having an adamantane structure may be an appropriately synthesized product or a commercially available product.

Examples of the commercially available product include product name: ADAMANTATE X-DA (available from Idemitsu Kosan Co., Ltd.), product name: ADAMANTATE X-A-201 (available from Idemitsu Kosan Co., Ltd.), product name: ADTM (available from Mitsubishi Gas Chemical Company, Inc.), and ADAMANTATE X-F-203 (available from Idemitsu Kosan Co., Ltd.).

A content of the (meth)acrylate compound having an alicyclic structure containing 6 or more carbon atoms in a molecule is not particularly limited and may be appropriately selected depending on the intended purpose. However, the content is preferably greater than or equal to 20% by mass but less than or equal to 100% by mass and more preferably greater than or equal to 50% by mass but less than or equal to 100% by mass of the curable composition. When the content of the (meth)acrylate compound having an alicyclic structure containing 6 or more carbon atoms in a molecule is greater than or equal to 20% by mass, a high hardness can be realized with the particular kind of the cyclic structure.

It is possible to analyze with, for example, an infrared microscope or by liquid chromatography whether the contact part of the elastic member contains the (meth)acrylate compound having an alicyclic structure containing 6 or more carbon atoms in a molecule, particularly, the (meth)acrylate compound having a tricyclodecane structure or the (meth) acrylate compound having an adamantane structure.

—Fluorine-Group-Containing Compound—

It is preferable that the ultraviolet-curable composition contain a fluorine-group-containing compound. The fluorine-group-containing compound having a low surface energy enables a smooth sliding over the image bearer and can also suppress wear of the elastic member.

Examples of the fluorine-group-containing compound include fluorine-based (meth)acrylate compounds.

The fluorine-based (meth)acrylate compounds are preferably fluorine-based (meth)acrylate compounds that contain a perfluoro polyether skeleton and more preferably fluorine-based (meth)acrylate compounds that contain a perfluoro polyether skeleton and 2 or more functional groups.

The fluorine-based (meth)acrylate compounds are not particularly limited and may be appropriately selected depending on the intended purpose. Examples of the fluorine-based (meth)acrylate compounds include 2,2,2-trifluoroethyl acrylate, 2,2,2-trifluoroethyl methacrylate, 2,2,3,3-tetrafluoropropyl acrylate, 2,2,3,3-tetrafluoropropyl methacrylate, 2,2,3,3,4,4,4-heptafluorobutyl acrylate, 2,2,3,3,4,4,4-heptafluorobutyl methacrylate, 2,2,3,4,4,4-hexafluorobutyl acrylate, 2,2,3,4,4,4-hexafluorobutyl methacrylate, 1,1,1,3,3,3-hexafluoroisopropyl acrylate, 1,1,1,3,3,3-hexafluoroisopropyl methacrylate, 1H,1H,5H-octafluoropentyl acrylate, 1H,1H,5H-octafluoropentyl methacrylate, 2,2,3,3,3-pentafluoropropyl acrylate, 2,2,3,3,3-pentafluoropropyl methacrylate, 2,2,3,3,4,4,5,5,6,6,7,7-dodecafluoroheptyl acrylate, 3,3,4,4,5,5,6,6,7,7,8,8,8-tridecafluorooctyl acrylate, 3,3,4,4,5,5,6,6,7,7,8,8,8-tridecafluorooctyl methacrylate, 2-[(1',1',1'-trifluoro-2'-(trifluoromethyl)-2'-hydroxy)propyl]-3-norbornyl methacrylate, 1,1,1-trifluoro-2-(trifluoromethyl)-2-hydroxy-4-methyl-5-pentyl methacrylate, 3,3,4,4,5,5,6,6,7,7,8,8,9,9,10,10,10-heptadecafluorodecyl acrylate, 3,3,4,4,5,5,6,6,7,7,8,8,9,9,10,10,10-heptadecafluorodecyl methacrylate, 3,3,4,4,5,5,6,6,7,7,8,8,9,9,10,10,11,11,12,12,12-henicosafluorododecyl acrylate, 3,3,4,4,5,5,6,6,7,7,8,8,9,9,10,10,11,11,12,12,12-henicosafluorododecyl methacrylate, and 3,3,4,4,5,5,6,6,7,7,8,8,9,9,10,10,11,12,12,12-henicosa-11-(trifluoro methyl)dodecyl methacrylate. One of these may be used alone or two or more of these may be used in combination.

The fluorine-based (meth)acrylate compounds may be a commercially available product. Examples of the commercially available product include OPTOOL DAC-HP (available from Daikin Industries, Ltd.), MEGAFAC RS-75 (available from DIC Corporation), and VISCOAT V-3F (available from Osaka Organic Chemical Industry Ltd.).

A content of the fluorine-group-containing compound in the curable composition is not particularly limited and may be appropriately selected depending on the intended purpose. However, the content expressed in a solid content is preferably greater than or equal to 0.1% by mass but less than or equal to 50% by mass.

The curable composition may also contain a (meth) acrylate compound having a molecular weight of greater than or equal to 100 but less than or equal to 1,500 in addition to the (meth)acrylate compound having an alicyclic structure containing 6 or more carbon atoms in a molecule and the fluorine-group-containing compound.

The (meth)acrylate compound having a molecular weight of greater than or equal to 100 but less than or equal to 1,500 is not particularly limited and may be appropriately selected depending on the intended purpose. Examples of the (meth) acrylate compound having a molecular weight of greater than or equal to 100 but less than or equal to 1,500 include dipentaerythritol hexa(meth)acrylate, pentaerythritol tetra (meth)acrylate, pentaerythritol tri(meth)acrylate, pentaerythritol ethoxy tetra(meth)acrylate, trimethylolpropane tri(meth)acrylate, trimethylolpropane ethoxy tri(meth)acrylate, 1,6-hexanediol di(meth)acrylate, ethoxylated bisphenol A di(meth)acrylate, propoxylated ethoxylated bisphenol A di(meth)acrylate, 1,4-butanediol di(meth)acrylate, 1,5-pentanediol di(meth)acrylate, 1,7-heptanediol di(meth)acrylate, 1,8-octanediol di(meth)acrylate, 1,9-nonanediol di(meth) acrylate, 1,10-decanediol di(meth)acrylate, 1,11-undecanediol di(meth)acrylate, 1,18-octadecanediol di(meth)acrylate, glycerin propoxy tri(meth)acrylate, dipropylene glycol di(meth)acrylate, tripropylene glycol di(meth)acrylate, PO-modified neopentyl glycol di(meth)acrylate, PEG 600 di(meth)acrylate, PEG 400 di(meth)acrylate, PEG 200 di(meth)acrylate, neopentyl glycol/hydroxypivalic acid ester di(meth)acrylate, octyl/decyl (meth)acrylate, isobornyl (meth)acrylate, ethoxylated phenyl (meth)acrylate, and 9,9-bis[4-(2-(meth)acryloyloxy ethoxy)phenyl]fluorene. One of these may be used alone or two or more of these may be used in combination.

Among these, a compound having a pentaerythritol triacrylate structure containing 3 or more but 6 or less functional groups is preferable.

Examples of the compound having a pentaerythritol triacrylate structure containing 3 or more but 6 or less functional groups include pentaerythritol triacrylate and dipentaerythritol hexaacrylate.

—Other Components—

The other components are not particularly limited and may be appropriately selected depending on the intended purpose. Examples of the other components include polymerization initiators, polymerization inhibitors, and solvents (diluents).

—Polymerization Initiator—

The polymerization initiator is not particularly limited and may be appropriately selected depending on the intended purpose so long as the polymerization initiator initiates polymerization by light, heat, or the like. However, preferable are a photoradical polymerization initiator and a photocationic polymerization initiator that produce active species such as radicals and cations by photo energy to initiate polymerization. A photoradical polymerization initiator is more preferable.

Examples of the photoradical polymerization initiator include aromatic ketones, acyl phosphine oxide compounds, aromatic onium salt compounds, organic peroxides, thio compounds (e.g., thioxanthone compounds and thiophenyl-group-containing compounds), hexaaryl biimidazole compounds, keto oxime ester compounds, borate compounds, azinium compounds, methallocene compounds, active ester compounds, compounds containing a carbon-halogen bond, and alkyl amine compounds.

Specific examples of these compounds include acetophenone, acetophenone benzyl ketal, 1-hydroxycyclohexyl phenyl ketone, 2,2-dimethoxy-2-phenyl acetophenone, xanthone, fluorenone, benzaldehyde, fluorene, anthraquinone, triphenyl amine, carbazol, 3-methylacetophenone, 4-chlorobenzophenone, 4,4'-dimethoxy benzophenone, 4,4'-diamino benzophenone, Michler's ketone, benzoin propyl ether, benzoin ethyl ether, benzyl dimethyl ketal, 1-(4-isopropylphenyl)-2-hydroxy-2-methylpropan-1-one, 2-hydroxy-2-methyl-1-phenylpropan-1-one, thioxanthone, diethyl thioxanthone, 2-isopropyl thioxanthone, 2-chloro thioxanthone, 2-methyl-1-[4-(methylthio)phenyl]-2-morpholino-propan-1-one, bis(2,4,6-trimethylbenzoyl)-phenyl phosphine oxide, 2,4,6-trimethyl benzoyl-diphenyl-phosphine oxide, 2,4-diethyl thioxanthone, bis-(2,6-dimethoxy benzoyl)-2,4,4-trimethyl pentyl phosphine oxide. One of these may be used alone or two or more of these may be used in combination.

The photoradical polymerization initiator may be a commercially available product. Examples of the commercially available product include: IRGACURE (registered trademark; the same applies hereinafter) 651, IRGACURE 184, DAROCUR (registered trademark) 1173, IRGACURE 2959, IRGACURE 127, IRGACURE 907, IRGACURE 369, IRGACURE 379, DAROCUR (registered trademark) TPO, IRGACURE 819, IRGACURE 784, IRGACURE OXE 01, IRGACURE OXE 02, IRGACURE 754, LUCIRIN (registered trademark) TPO, LR8893, and LR8970 (all available from BASF Japan Ltd.); SPEEDCURE (registered trademark) TPO (available from Lambson Ltd.); KAYACURE (registered trademark) DETX-S (available from Nippon Kayaku Co., Ltd.); and EBECRYL P36 (available from UCB Japan Co., Ltd.). One of these may be used alone or two or more of these may be used in combination.

A content of the photoradical polymerization initiator is not particularly limited and may be appropriately selected depending on the intended purpose. However, when the content of the photoradical polymerization initiator is high, an elastic power tends to be low. Therefore, from a viewpoint of the need of suppressing the content of the photoradical polymerization initiator to obtain a contact part having a high elasticity, the content is preferably from greater than or equal to 1% by mass but less than or equal to 10% by mass of the total mass of the curable composition. When the content of the photoradical polymerization initiator is greater than or equal to 1% by mass but less than or equal to 10% by mass, the curable composition is less likely to cause a curing failure, makes the elastic member less likely to curl, and can easily impregnate the elastic member without being large in the molecular size to be able to provide a high hardness to the contact part.

—Polymerization Inhibitor—

The polymerization inhibitor is not particularly limited and may be appropriately selected depending on the intended purpose. Examples of the polymerization inhibitor include phenol compounds, quinone compounds, amine compounds, nitro compounds, oxime compounds, and sulfur compounds.

Examples of the phenol compounds include p-methoxy phenol, cresol, t-butyl catechol, di-t-butyl paracresol, hydroquinone monomethyl ether, α-naphthol, 3,5-di-t-butyl-4-hydroxy toluene, 2,2'-methylene bis(4-methyl-6-t-butyl phenol), 2,2'-methylene bis(4-ethyl-6-butyl phenol), and 4,4'-thio bis(3-methyl-6-t-butyl phenol). One of these may be used alone or two or more of these may be used in combination.

Examples of the quinone compounds include p-benzoquinone, anthraquinone, naphthoquinone, phenanthraquinone, p-xyloquinone, p-toluquinone, 2,6-dichloroquinone, 2,5-diphenyl-p-benzoquinone, 2,5-diacetoxy-p-benzoquinone, 2,5-dicaproxy-p-benzoquinone, 2,5-diacyloxy-p-benzoquinone, hydroquinone, 2,5-di-butyl hydroquinone, mono-t-butyl hydroquinone, monomethyl hydroquinone, and 2,5-di-t-amyl hydroquinone.

Examples of the amine compounds include phenyl-β-naphthyl amine, p-benzyl amino phenol, di-β-naphthyl paraphenylenediamine, dibenzyl hydroxyl amine, phenyl hydroxyl amine, and diethyl hydroxyl amine.

Examples of the nitro compounds include dinitro benzene, trinitro toluene, and a picric acid.

Examples of the oxime compounds include quinone dioxime and cyclohexanone oxime.

Examples of the sulfur compounds include phenothiazine.

—Solvent (Diluent)—

The solvent is not particularly limited and may be appropriately selected depending on the intended purpose so long as the solvent can dissolve the (meth)acrylate compound having an alicyclic structure in a molecule and swell the elastic member. Examples of the solvent include a hydrocarbon-based solvent, an ester-based solvent, a ketone-based solvent, an ether-based solvent, and an alcohol-based solvent. One of these may be used alone or two or more of these may be used in combination.

Examples of the hydrocarbon-based solvent include toluene and xylene.

Examples of the ester-based solvent include ethyl acetate, n-butyl acetate, methyl cellosolve acetate, and propylene glycol monomethyl ether acetate.

Examples of the ketone-based solvent include methyl ethyl ketone, methyl isobutyl ketone, diisobutyl ketone, cyclohexanone, and cyclopentanone.

Examples of the ether-based solvent include ethylene glycol monomethyl ether, ethylene glycol monoethyl ether, and propylene glycol monomethyl ether.

Examples of the alcohol-based solvent include ethanol, propanol, 1-butanol, isopropyl alcohol, and isobutyl alcohol.

Among these solvents, cyclohexanone is particularly preferable.

A concentration of the solvent is not particularly limited and may be appropriately selected depending on the intended purpose so long as the solvent can dissolve the ultraviolet-curable composition and swell the elastic member.

A method for impregnating the contact part of the elastic member with the curable composition is not particularly limited and may be appropriately selected depending on the intended purpose. Examples of the method include a method for impregnating the contact part of the elastic member with the curable composition by brushing, dip coating, etc. and then curing the curable composition.

An ambient temperature when impregnating the contact part with the curable composition is not particularly limited and may be appropriately selected depending on the intended purpose. However, the ambient temperature is preferably higher than or equal to 10° C. but lower than or equal to 40° C.

A method for curing the curable composition that has impregnated the contact part of the cleaning blade is not particularly limited and may be appropriately selected depending on the intended purpose. Examples of the method include treatments by ultraviolet irradiation, heating, etc. Among these, a treatment by ultraviolet irradiation is preferable.

An ultraviolet irradiating apparatus is not particularly limited and may be appropriately selected depending on the intended purpose. Examples of the ultraviolet irradiating apparatus include an ultraviolet irradiating apparatus provided with an ultraviolet light source inside the apparatus and configured to irradiate a curing target with ultraviolet rays while conveying the curing target with a conveying unit such as a conveyor.

The ultraviolet light source is not particularly limited and may be appropriately selected depending on the intended purpose so long as the ultraviolet light source is adapted to the polymerization initiator. Examples of the ultraviolet light source include lamps and ultraviolet light-emitting semiconductor elements.

Examples of the lamps include a metal halide lamp, a xenon lamp, a carbon arc lamp, a chemical lamp, a low-pressure mercury lamp, and a high-pressure mercury lamp. The lamp may be a commercially available product. Examples of the commercially available product include an H valve, a D valve, and a V valve available from Heraeus Holding GmbH.

Examples of the ultraviolet light-emitting semiconductor elements include an ultraviolet light-emitting diode and an ultraviolet light-emitting laser diode.

A kind of the ultraviolet rays is not particularly limited and may be appropriately selected depending on the intended purpose so long as the ultraviolet rays are adapted to the polymerization initiator contained in the curable composition. Examples of the kind of the ultraviolet rays include ultraviolet rays of longer than or equal to 400 nm but shorter than or equal to 200 nm, far-ultraviolet rays, g rays, h rays, i rays, KrF excimer laser light, ArF excimer laser light, electron beams, X rays, molecular beams, and ion beams.

Conditions for ultraviolet irradiation used for curing the curable composition are not particularly limited and may be appropriately selected depending on the intended purpose. However, a cumulative light volume is preferably greater than or equal to 500 mJ/cm$^2$ but less than or equal to 25,000 mJ/cm$^2$. More specifically, when the curable composition which contains tricyclodecanedimethanol diacrylate and a commercially available polymerization initiator IRGACURE (registered trademark) 184 available from BASF Japan Ltd. is irradiated by a belt conveyor-type ultraviolet irradiator (product name: ECS-1511U available from Eye Graphics Co., Ltd.) configured to irradiate an irradiation target with ultraviolet rays while conveying the irradiation target and passing the irradiation target through a light source set inside the irradiator, the number of times the curable composition is passed through the belt conveyor-type ultraviolet irradiator is preferably greater than or equal to 1 pass (1 passage) but less than or equal to 5 passes (5 passages) under irradiation conditions that the power output of the light source is 176 W/cm and the conveyor speed is 0.8 m/min.

—Martens Hardness—

A Martens hardness at a position that is on the plate surface of the flat-plate-shaped elastic member and is reached by proceeding by 20 μm from the edge of the contact part in a direction toward a portion of the contact part facing the edge is preferably greater than or equal to 2 N/mm$^2$ but less than or equal to 10 N/mm$^2$ and more preferably greater than or equal to 3 N/mm$^2$ but less than or equal to 8 N/mm$^2$.

When the Martens hardness at the position reached by proceeding by 20 μm from the edge of the contact part in a direction toward a portion of the contact part facing the edge is greater than or equal to 2 N/mm$^2$ but less than or equal to 10 N/mm$^2$, a favorable cleaning property can be obtained without cracking due to an excessive hardness at the edge of the contact part or curling due to an excessive softness inversely.

A Martens hardness at a position reached by proceeding by 100 μm from the edge of the contact part in a direction toward a portion of the contact part facing the edge is preferably greater than or equal to 1.5 N/mm$^2$ and more preferably greater than or equal to 1.5 N/mm$^2$ but less than or equal to 2.5 N/mm$^2$.

When the Martens hardness at the position reached by proceeding by 100 μm from the edge of the contact part in a direction toward a portion of the contact part facing the edge is greater than or equal to 1.5 N/mm$^2$, a favorable cleaning property can be obtained without cracking due to an excessive hardness at the edge of the contact part or curling due to an excessive softness inversely.

The Martens hardness can be measured with, for example, a microhardness meter (product name: HM-2000 available from Fischer Instruments K.K.) by indenting a Vickers indenter in 10 seconds such that the maximum load will be 1.0 mN, maintaining the Vickers indenter there for 5 seconds, and removing the force of 1.0 mN in 10 seconds.

<Supporting Member>

The supporting member may be of any shape, any size, and any material that may be appropriately selected depending on the intended purpose. The shape of the supporting member is not particularly limited and may be appropriately selected depending on the intended purpose. Examples of the shape include a flat plate shape, a strip shape, and a sheet shape.

The size of the supporting member is not particularly limited and may be appropriately selected according to the size of the cleaning target member. The material of the supporting member is not particularly limited and may be appropriately selected depending on the intended purpose. Examples of the material include a metal, plastic, and ceramic. Among these, a metal plate is preferable in terms of strength, and a steel plate made of a stainless steel, an aluminium plate, and a phosphor-bronze plate are particularly preferable.

<Cleaning Target Member>

The cleaning target member may be of any shape, any structure, any size, and any material that may be appropriately selected depending on the intended purpose. Examples of the cleaning target include an image bearer.

The shape of the cleaning target member is not particularly limited and may be appropriately selected depending on the intended purpose. Examples of the shape include a drum shape, a belt shape, a flat plate shape, and a sheet shape.

The size of the cleaning target member is not particularly limited and may be appropriately selected depending on the intended purpose. However, a size that is about a commonly used size is preferable.

The material of the cleaning target member is not particularly limited and may be appropriately selected depending on the intended purpose. Examples of the material include a metal, plastic, and ceramic.

<Residue>

The residue is not particularly limited and may be appropriately selected depending on the intended purpose so long as the residue is a matter that adheres to the surface of the cleaning target member and can be the target of removal by the cleaning blade. Examples of the residue include a toner, a lubricant, inorganic particles, organic particles, litter, dust, and mixtures of these.

The cleaning blade of the present invention has the properties described above and can be used widely in various fields. The cleaning blade of the present invention is particularly favorably used for an image forming apparatus, an image forming method, and a process cartridge of the present invention described below.

(Image Forming Apparatus and Image Forming Method)

An image forming apparatus of the present invention includes at least an image bearer, a charging unit, an exposing unit, a developing unit, a transfer unit, a fixing unit, and a cleaning unit, and further includes other units appropriately selected as needed. The charging unit and the exposing unit may sometimes be referred to collectively as an electrostatic latent image forming unit.

An image forming method used in the present invention includes at least a charging step, an exposing step, a developing step, a transferring step, a fixing step, and a cleaning step, and further includes other steps appropriately selected as needed. The charging step and the exposing step may sometimes be referred to collectively as an electrostatic latent image forming step.

The image forming method used in the present invention can be favorably performed by the image forming apparatus of the present invention. The charging step can be performed by the charging unit. The exposing step can be performed by the exposing unit. The developing step can be performed by the developing unit. The transferring step can be performed by the transfer unit. The fixing step can be performed by the fixing unit. The cleaning step can be performed by the cleaning unit. The other steps can be performed by the other units.

<Image Bearer>

The image bearer (hereinafter may be referred to as "electrophotographic photoconductor" or "photoconductor") may be of any shape, any structure, any size, and any material that may be appropriately selected depending on the intended purpose.

The shape of the image bearer is not particularly limited and may be appropriately selected depending on the intended purpose. Examples of the shape include a drum shape and a belt shape.

The material of the image bearer is not particularly limited and may be appropriately selected depending on the intended purpose. Examples of the image bearer include an inorganic photoconductor made of an amorphous silicon, selenium, etc. and an organic photoconductor (OPC) made of polysilane, phthalopolymethine, etc.

<Charging Step and Charging Unit>

The charging step is a step of charging the surface of the electrophotographic photoconductor and is performed by the charging unit.

The charging unit is not particularly limited and may be appropriately selected depending on the intended purpose so long as the charging unit can charge the surface of the electrophotographic photoconductor uniformly by applying a voltage. The charging unit is roughly classified into (1) a charging unit of a contact type configured to charge the electrophotographic photoconductor by contacting the electrophotographic photoconductor and (2) a charging unit of a contactless type configured to charge the electrophotographic photoconductor in a contactless manner.

Examples of (1) the charging unit of the contact type include a conductive or semi-conductive charging roller, a magnetic brush, a fur brush, a film, and a rubber blade. Among these, the charging roller can significantly reduce the amount of ozone emission compared to the amount of ozone emission in a corona discharge, is excellent in stability through repeated use of the electrophotographic photoconductor, and is effective for preventing image quality degradation.

The magnetic brush is constituted by, for example, a non-magnetic conductive sleeve supporting particles of various kinds of ferrites such as a Zn—Cu ferrite and a magnet roll embraced within the sleeve.

The fur brush is formed by, for example, winding or pasting a fur that is treated to have conductivity with carbon, copper sulfide, a metal or a metal oxide, etc. around a metal or a cored bar that is treated to have conductivity.

Examples of (2) the charging unit of the contactless type include: a contactless charger, a needle electrode device, and a solid discharging element utilizing a corona discharge; and a conductive or semi-conductive charging roller disposed at a slight gap from the electrophotographic photoconductor.

Among these, preferable as the charging unit is one that includes a roller-shaped charging member disposed in contact with the electrophotographic photoconductor and a voltage applying member configured to apply a direct-current voltage to the roller-shaped charging member. This can save the power cost for a charging voltage to be applied to the roller-shaped charging member.

<Exposing Step and Exposing Unit>

The exposing step is a step of exposing the charged surface of the image bearer to light and is performed by the exposing unit. The exposing can be performed by, for example, exposing the surface of the image bearer to light imagewise with the exposing unit.

An optical system for the exposing is roughly classified into an analog optical system and a digital optical system. The analog optical system is an optical system configured to directly project a document over the surface of the image bearer through an optical system. The digital optical system is an optical system configured to receive image information in the form of an electric signal, convert the electric signal to an optical signal, and expose the electrophotographic photoconductor to light to form an image.

The exposing unit is not particularly limited and may be appropriately selected depending on the intended purpose so long as the exposing unit can expose the surface of the image bearer charged by the charging unit to light imagewise as the image desired to be formed. Examples of the exposing unit include various exposing devices such as a copier optical system, a rod lens array system, a laser optical system, a liquid crystal shutter optical system, and an LED optical system. In the present invention, a backlighting system configured to expose the image bearer to light imagewise from the back surface of the image bearer may be employed.

A light source of the exposing unit is not particularly limited and may be appropriately selected depending on the intended purpose so long as the light source is configured to emit light. Examples of the light source include a fluorescent lamp, a tungsten lamp, a halogen lamp, a mercury lamp, a sodium vapor lamp, a light emitting diode (LED), a laser diode (LD), and electroluminescence (EL). Among these light sources, a light emitting diode and a laser diode are preferable because these diodes emit light having a high irradiation energy and a wavelength in a range of from 600 nm through 800 nm.

In order to obtain irradiation with only light of a desired wavelength range, various filters such as a sharp cut filter, a band pass filter, a near infrared cut filter, a dichroic filter, an interference filter, and a color conversion filter may be used.

These light sources can also be used as a charge eliminating lamp, etc.

<Developing Step and Developing Unit>

The developing step is a step of developing the electrostatic latent image to form a toner image and is performed by the developing unit.

The developing unit is not particularly limited and may be appropriately selected depending on the intended purpose so long as the developing unit can perform developing using a toner. Preferable examples of the developing unit include a developing unit that includes a developing device containing the toner and capable of supplying the toner to the electrostatic latent image in a contact manner or in a contactless manner.

The developing device may be of a dry developing system or a wet developing system or may be a developing device for a single color or a developing device for multiple colors. Preferable examples of the developing device include a developing device that includes a stirrer configured to frictionally stir the toner to charge the toner and a rotatable magnet roller.

In the developing device, for example, the toner, and as needed, a carrier are mixed and stirred, which produces a friction by which the toner is charged to be supported over the surface of the rotating magnet roller in a chain-like form to form a magnetic brush. Because the magnet roller is disposed near the image bearer, some part of the toner constituting the magnetic brush formed over the surface of the magnet roller is transferred to the surface of the image bearer by an electric attractive force of the electrostatic latent image. As a result, the electrostatic latent image is developed by the toner to form the toner image over the surface of the image bearer.

The toner contained in the developing device may be in the form of a developer containing the toner. The developer may be a one-component developer or a two-component developer.

The toner preferably contains toners for 2 or more colors and more preferably is a full-color toner.

<Transferring Step and Transfer Unit>

The transferring step is a step of transferring the toner image onto a recording medium and is performed by the transfer unit.

A preferable mode of the transferring step includes a primary transferring step of, using an intermediate transfer medium, transferring the toner image onto the surface of the intermediate transfer medium to form a composite transferred image and a secondary transferring step of transferring the composite transferred image onto a recording medium.

The intermediate transfer medium is not particularly limited and may be appropriately selected depending on the intended purpose. Examples of the intermediate transfer medium include a transfer belt. The transferring can be performed by the transfer unit and can be performed by, for example, charging a transfer roller.

The transfer unit is not particularly limited and may be appropriately selected depending on the intended purpose. A preferable mode of the transfer unit includes a primary transfer unit configured to transfer the toner image onto the surface of the intermediate transfer medium to form a composite transferred image and a secondary transfer unit configured to transfer the composite transferred image onto a recording medium.

The primary transfer unit and the secondary transfer unit preferably include at least a transfer device configured to charge the toner image formed over the surface of the image bearer to be peeled to a recording medium.

The transfer device is not particularly limited and may be appropriately selected depending on the intended purpose. Examples of the transfer device include a corona transfer device utilizing a corona discharge, a transfer belt, a transfer roller, a pressure transfer roller, and an adhesive transfer device. There may be one transfer device or two or more transfer devices.

The recording medium is not particularly limited and may be appropriately selected depending on the intended purpose so long as the toner image developed but not fixed can be transferred onto the recording medium. A representative example of the recording medium is plain paper. However, for example, a PET base and the like for OHP may also be used.

<Fixing Step and Fixing Unit>

The fixing step is a step of fixing the toner image transferred onto the recording medium and is performed by the fixing unit. When toners of 2 or more colors are used, fixing may be performed each time a toner of any color is transferred onto the recording medium or may be performed when the toners of all colors are transferred onto the recording medium and overlaid together.

The fixing unit is not particularly limited and may be appropriately selected depending on the intended purpose. A thermal fixing system utilizing a known heating pressuring unit may be employed.

Examples of the heating pressurizing unit include a combination of a heating roller and a pressure roller and a combination of a heating roller, a pressure roller, and an endless belt. A heating temperature is not particularly limited and may be appropriately selected depending on the intended purpose. However, the heating temperature is preferably in a range of from 80° C. through 200° C. As needed, a known optical fixing device may be used in combination with the fixing unit.

<Cleaning Step and Cleaning Unit>

The cleaning step is a step of removing the toner remaining over the surface of the image bearer and is performed by the cleaning unit.

The cleaning blade of the present invention is used as the cleaning unit.

The linear pressure applied by the elastic member to the surface of the image bearer is not particularly limited and may be appropriately selected depending on the intended purpose. However, the linear pressure is preferably greater than or equal to 10 N/m but less than or equal to 100 N/m and more preferably greater than or equal to 10 N/m but less than or equal to 50 N/m. When the linear pressure is greater than or equal to 10 N/m but less than or equal to 100 N/m, a cleaning failure of the toner slipping through a gap between the contact part and the cleaning target member is less likely to occur and the elastic member is less likely to curl.

The linear pressure can be measured with a measuring instrument in which a small-size compressive load cell available from Kyowa Electronic Instruments Co., Ltd. is incorporated.

An angle formed between a tangent line over the cleaning target member at a position at which the contact part of the elastic member contacts the cleaning target member and the end surface of the elastic member at the free end (hereinafter, this angle will be referred to as "cleaning angle θ") is not particularly limited and may be appropriately selected depending on the intended purpose. However, the cleaning angle θ is preferably greater than or equal to 65° but less than or equal to 85°.

When the cleaning angle θ is greater than or equal to 65° but less than or equal to 85°, the elastic member is less likely to cause curling and a cleaning failure.

<Other Steps and Other Units>

Examples of the other steps include a lubricant applying step, a charge eliminating step, a recycling step, and a controlling step.

Examples of the other units include a lubricant supplying unit, a charge eliminating unit, a recycling unit, and a controlling unit.

—Lubricant Applying Step and Lubricant Supplying Unit—

The lubricant applying step is a step of applying a lubricant over the surface of the image bearer and is performed by the lubricant supplying unit.

—Charge Eliminating Step and Charge Eliminating Unit—

The charge eliminating step is a step of applying a charge eliminating bias voltage to the image bearer to eliminate charges from the image bearer and performed by the charge eliminating unit.

The charge eliminating unit is not particularly limited and may be appropriately selected depending on the intended purpose so long as the charge eliminating unit is capable of applying a charge eliminating bias voltage to the image bearer. Preferable examples of the charge eliminating unit include a charge eliminating lamp.

—Recycling Step and Recycling Unit—

The recycling step is a step of recycling the toner removed in the cleaning step to the developing unit and is performed by the recycling unit.

The recycling unit is not particularly limited and may be appropriately selected depending on the intended purpose. Examples of the recycling unit include a known conveying unit.

—Controlling Step and Controlling Unit—

The controlling step is a step of controlling each of the steps described above and is performed by the controlling unit.

The controlling unit is not particularly limited and may be appropriately selected depending on the intended purpose so long as the controlling unit is capable of controlling the operation of each unit. Examples of the controlling unit include devices such as a sequencer and a computer.

—Toner—

The toner contains toner base particles and an external additive and further contains other components as needed.

The toner may be a monochrome toner or a color toner.

The toner base particles contain at least a binder resin and a colorant and further contain other components such as a release agent and a charge controlling agent as needed.

(Process Cartridge)

A process cartridge of the present invention is a device (unit) attachably and detachably mounted in the image forming apparatus.

The cleaning blade of the present invention may be included in the process cartridge instead of being included in the image forming apparatus in a secured state. In this case, the process cartridge includes: at least any one of the image bearer, the charging unit, the exposing unit, the developing unit, and the transfer unit; and the cleaning unit, and further includes other units as needed.

Here, an example of the image forming apparatus of the present invention will be described with reference to the drawings.

The number, position, shape, etc. of the constituting members described below are not limited to those in the present embodiment but may be a number, position, shape, etc. preferable for working the present invention.

FIG. 1 is a schematic cross-sectional view illustrating an image forming apparatus according to an embodiment of the present invention.

As illustrated in FIG. 1, an image forming apparatus 500 includes at least an optical writing unit 40, image forming units 1, a transfer unit 60, a first paper feeding cassette 151 and a second paper feeding cassette 152, a fixing unit 80, and toner cartridges 100 and further includes other constituting members as needed.

The optical writing unit 40 as the latent image forming unit includes at least a polygon mirror 41 and further includes other constituting members as needed. The optical writing unit 40 is disposed in about the center of the image forming apparatus 500 and configured to emit laser light L based on image information.

The laser light L is polarized by the polygon mirror 41 driven to rotate by a motor and photoconductors 3Y, 3C, 3M, and 3K of the respective image forming units 1Y, 1C, 1M, and 1K for yellow, magenta, cyan, and black (hereinafter may be referred to as Y, C, M, and K) are irradiated with the laser light L through a plurality of optical lenses and mirrors. As a result, electrostatic latent images for Y, C, M, and K are formed over the surfaces of the photoconductors 3Y, 3C, 3M, and 3K.

Instead of the above-described configuration in which the optical writing unit irradiates the image forming units with the laser light, a configuration in which an LED array optically scans the image forming units may be employed.

The image forming units 1 include at least four image forming units 1Y, 1C, 1M, and 1K and further include other constituting members as needed.

The image forming units 1Y, 1C, 1M, and 1K are disposed above the optical writing unit 40, include at least the photoconductors 3Y, 3C, 3M, and 3K, and further include other constituting members as needed. The image forming units 1Y, 1C, 1M, and 1K are configured to develop the electrostatic latent images formed over the surfaces of the photoconductors 3Y, 3C, 3M, and 3K by the optical writing unit 40 to toner images of the respective colors.

The four image forming units 1Y, 1C, 1M, and 1K use Y, C, M, and K toners having different colors as image forming substances for developing the electrostatic latent images to the toner images but are identical with one another in any other respect.

The transfer unit 60 as the transfer unit includes at least an intermediate transfer belt 14, four primary transfer rollers 7Y, 7C, 7M, and 7K, a secondary transfer backup roller 66, a driving roller 67, an auxiliary roller 68, a tension roller 69, a belt cleaning unit 162, a first bracket 63, and a second bracket 64 and further includes other constituting members as needed. The transfer unit 60 is disposed above the image forming units 1 and configured to transfer the toner images of the colors formed over the surfaces of the photoconductors 3Y, 3C, 3M, and 3K onto the surface of the endless intermediate transfer belt 14 in an overlaid state to form a four-color-overlaid toner image (hereinafter may be referred to as a four-color toner image). The transfer unit 60 is also capable of forming a monochrome toner image using only the photoconductor 3K.

The intermediate transfer belt 14 is configured to rotate (endlessly move) in the counterclockwise direction of FIG. 1 by being driven by the driving roller 67 while being tensed by eight roller members including the four primary transfer rollers 7Y, 7C, 7M, and 7K, the secondary transfer backup roller 66, the driving roller 67, the auxiliary roller 68, and the tension roller 69. A transfer bias voltage having an opposite polarity (e.g., a negative polarity) to the polarity of the toner (e.g., a positive polarity) is applied to a back surface (i.e., an internal surface of the loop) of the intermediate transfer belt 14.

The four primary transfer rollers 7Y, 7C, 7M, and 7K nip the endlessly-moving intermediate transfer belt 14 between the primary transfer rollers 7Y, 7C, 7M, and 7K and the photoconductors 3Y, 3C, 3M, and 3K to form primary transfer nips.

During a process of the intermediate transfer belt 14 sequentially passing through the primary transfer nips for Y, C, M, and K along with the endless move of the intermediate transfer belt 14, the Y, C, M, and K toner images over the surfaces of the photoconductors 3Y, 3C, 3M, and 3K are primarily transferred onto the top surface (i.e., an external surface of the loop) of the intermediate transfer belt 14 in an overlaid state by the effect of an electrostatic force. As a result, the four-color toner image mentioned above is formed over the surface of the intermediate transfer belt 14.

The four-color toner image is transferred by the transfer unit 60 onto a recording medium P fed from the first paper feeding cassette 151 or the second paper feeding cassette 152.

The secondary transfer backup roller 66 forms a secondary transfer nip while nipping the intermediate transfer belt 14 between the secondary transfer backup roller 66 and a secondary transfer roller 70 disposed outside the loop formed by the endless intermediate transfer belt 14.

A pair of registration rollers 55 are configured to convey a recording medium P nipped between the rollers to the secondary transfer nip at a timing synchronized with the four-color toner image primarily transferred onto the endlessly-moving intermediate transfer belt 14.

The four-color toner image over the surface of the intermediate transfer belt 14 is secondarily transferred onto the recording medium P simultaneously at the secondary transfer nip under the influences of a secondary-transfer electric field formed between the secondary transfer roller 70 to which a secondary transfer bias voltage is applied and the secondary transfer backup roller 66 and a nip pressure. As a result, the four-color toner image combines with the white color of the recording medium P and becomes a full-color toner image.

The belt cleaning unit 162 includes a belt cleaning blade 162*a*. The belt cleaning unit 162 is disposed near the driving roller 67 and configured to bring the belt cleaning blade 162*a* into contact with the top surface of the intermediate transfer belt 14 to scrape off and remove the untransferred toner remaining over the surface of the intermediate transfer belt 14.

The first bracket 63 is used for forming a monochrome image and disposed in a horizontal direction of the primary transfer rollers 7Y, 7C, and 7M. The first bracket 63 is configured to pivot about a rotational shaft of the auxiliary roller 68 by a predetermined rotation angle when an unillustrated solenoid is driven on or off.

When forming and outputting a monochrome image, the image forming apparatus 500 controls the first bracket 63 to pivot slightly in the counterclockwise direction of FIG. 1 by driving the solenoid. As a result, the primary transfer rollers 7Y, 7C, and 7M for Y, C, and M pivot simultaneously in the counterclockwise direction of FIG. 1 about the rotational shaft of the auxiliary roller 68 to enable the intermediate transfer belt 14 to be separated from the photoconductors 3Y, 3C, and 3M for Y, C, and M. This makes it possible to avoid wearing each member constituting the image forming units 1 for Y, C, and M due to wastefully driving these image forming units 1 during formation of a monochrome image.

A monochrome image is formed by driving only the image forming unit 1K for K among the four image forming units 1Y, 1C, 1M, and 1K.

The first paper feeding cassette 151 and the second paper feeding cassette 152 are disposed below the optical writing unit 40 in a state of being stacked one over another in the vertical direction, include at least a first paper feeding roller 151*a*, a second paper feeding roller 152*a*, a paper feeding path 153, a pair of conveying rollers 154, and a pair of registration rollers 55, and further include other constituting members as needed.

A plurality of recording media P are contained in each of the paper feeding cassettes in a state of a sheaf in which the recording media are stacked. The first paper feeding roller 151*a* and the second paper feeding roller 152*a* are in contact with the topmost recording media P, respectively. When the first paper feeding roller 151*a* is driven to rotate in the counterclockwise direction of FIG. 1 by an unillustrated driving unit, the topmost recording medium P in the first paper feeding cassette 151 is discharged toward the paper feeding path 153 disposed to extend in the vertical direction at the right-hand side of the first paper feeding cassette 151 in FIG. 1. When the second paper feeding roller 152*a* is driven to rotate in the counterclockwise direction of FIG. 1 by an unillustrated driving unit, the topmost recording medium P in the second paper feeding cassette 152 is discharged toward the paper feeding path 153.

A plurality of pairs of conveying rollers 154 are disposed in the paper feeding path 153. The plurality of pairs of conveying rollers 154 are configured to convey the recording medium P that has been conveyed up to the paper feeding path 153 in the vertical direction of FIG. 1 along the paper feeding path 153.

The pair of registration rollers 55 are disposed at the downstream from the pairs of conveying rollers 154 in the conveying direction of the paper feeding path 153 and configured to nip the recording medium P that has been conveyed up to the pair of registration rollers 55 by the pairs of conveying rollers 154 between the registration rollers 55 and once stop rotating at the same time. After stopping once, the pair of registration rollers 55 convey the recording medium P at an appropriate timing to the secondary transfer nip formed by the intermediate transfer belt 14 being nipped between the secondary transfer backup roller 66 and the secondary transfer roller 70 disposed outside the loop of the intermediate transfer belt 14.

The recording medium P that has been conveyed to the secondary transfer nip receives the four-color toner image formed over the intermediate transfer belt 14 and transferred by the transfer unit 60 and is conveyed to the fixing unit 80.

The fixing unit 80 is disposed above the secondary transfer nip, includes at least a heating roller 83, a tension roller 85, a driving roller 86, a fixing belt 84 as a fixing member, a pressurizing heating roller 81, an unillustrated temperature sensor, and an unillustrated fixing power source circuit, and further includes other constituting members as needed. The fixing unit 80 is configured to fix the four-color toner image transferred onto the recording medium P by heating and pressurizing.

The heating roller 83, the tension roller 85, and the driving roller 86 support the endless fixing belt 84 in a tense state and endlessly move the fixing belt 84 in the counterclockwise direction of FIG. 1. During a process of the endless move, the fixing belt 84 is heated by the heating roller 83 incorporating a heat generating source such as a halogen lamp from the back of the fixing belt 84.

The pressurizing heating roller 81 is in contact with the heating roller 83 via the fixing belt 84 at a portion at which the fixing belt 84 is hung over the heating roller 83 and is driven to rotate in the clockwise direction of FIG. 1. Hence, a fixing nip at which the pressurizing heating roller 81 and the fixing belt 84 contact each other is formed. Like the heating roller 83, the pressurizing heating roller 81 incorporates a heat generating source.

The unillustrated temperature sensor is disposed outside the loop of the endless fixing belt 84 to face the top surface of the fixing belt 84 at a predetermined interval and configured to sense the surface temperature of the fixing belt 84 immediately before proceeding to the fixing nip. The sensed result is sent to an unillustrated fixing power source circuit. The fixing power source circuit is configured to control turning on or off power supply to the heat generating source incorporated in the heating roller 83 and the heat generating source incorporated in the pressurizing heating roller 81.

The recording medium P that has passed through the secondary transfer nip is conveyed into the fixing unit 80 having the above-described configuration after separated from the intermediate transfer belt 14. The fixing unit 80 is configured to fix the full-color toner image over the recording medium P that has been conveyed to the fixing unit 80 by heating and pressurizing the recording medium P during a process of conveying the recording medium P in the vertical direction of FIG. 1 while nipping the recording medium P at the fixing nip.

The recording medium P that has undergone the full-color toner image fixing process is conveyed by a pair of paper ejecting rollers 87 and ejected onto a stacking portion 88 formed at the top of the housing of the body of the image forming apparatus 500. Ejected recording media P are stacked on the stacking portion 88 sequentially.

The toner cartridges 100 include at least toner cartridges 100Y, 100C, 100M, and 100K and further include other constituting members as needed. The toner cartridges 100 are disposed above the transfer unit 60. The toner cartridges 100Y, 100C, 100M, and 100K contain Y, C, M, and K toners. The Y, C, M, and K toners are appropriately supplied into developing devices 5Y, 5C, 5M, and 5K of the image forming units 1Y, 1C, 1M, and 1K.

The toner cartridges 100Y, 100C, 100M, and 100K are independent from the image forming units 1Y, 1C, 1M, and 1K and disposed attachably to and detachably from the image forming apparatus 500.

Figure 2:
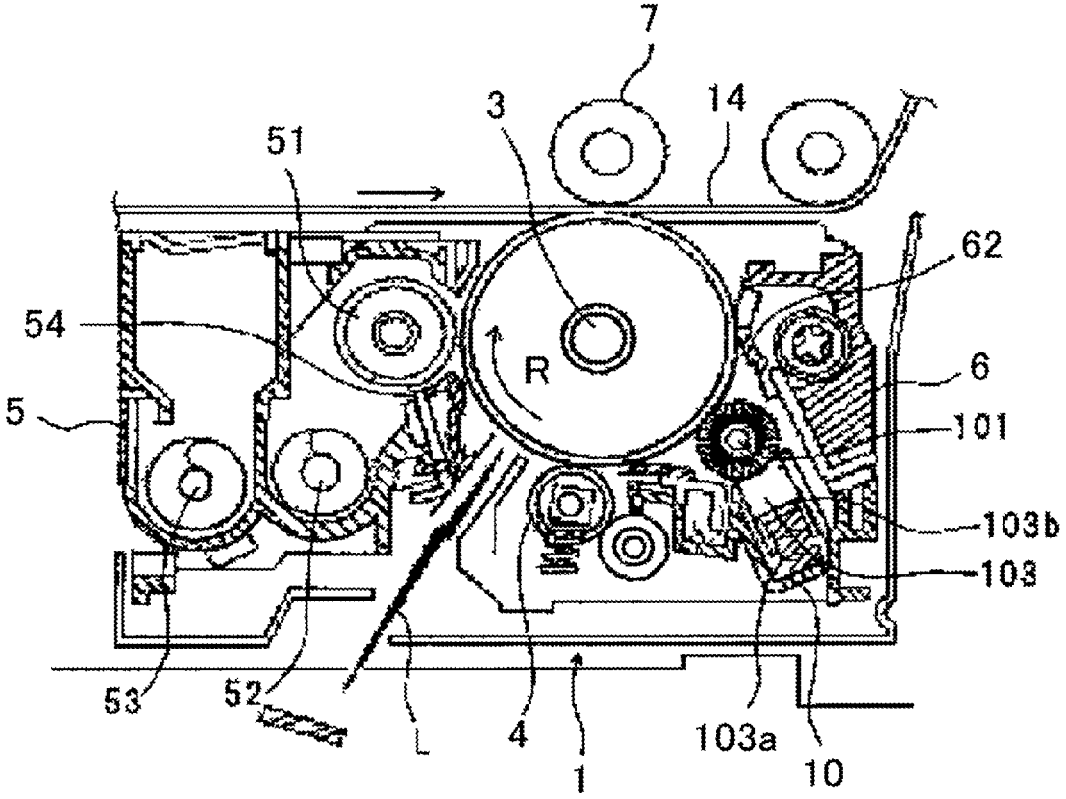
FIG. 2 is a schematic cross-sectional view illustrating an image forming unit of an image forming apparatus according to an embodiment of the present invention.

FIG. 2 is a schematic cross-sectional view illustrating an image forming unit of an image forming apparatus according to an embodiment of the present invention.

As illustrated in FIG. 2, the image forming unit 1 includes at least a photoconductor 3, a charging roller 4, a developing device 5, a primary transfer roller 7, a cleaning device 6, a lubricant applying device 10, and an unillustrated charge eliminating lamp and further includes other constituting members as needed.

The charging roller 4, the developing device 5, the primary transfer roller 7, the cleaning device 6, the lubricant applying device 10, and the unillustrated charge eliminating lamp are disposed around the photoconductor 3 which is an image bearer.

In FIG. 2, the photoconductor 3 has a drum shape. However, the photoconductor 3 may have a sheet shape or an endless belt shape.

The charging roller 4 is a charging member disposed at a predetermined distance from the photoconductor 3 in a contactless manner and included in a charging device as a charging unit. The charging roller 4 is configured to charge the photoconductor 3 to a predetermined polarity up to a predetermined electric potential. The surface of the photoconductor 3 uniformly charged by the charging roller 4 is irradiated with the laser light L by the optical writing unit 40 illustrated in FIG. 1 based on image information to have an electrostatic latent image formed.

The charging device is a contactless proximal disposing system in which the charging roller 4 is set close to the photoconductor 3 and may be a known configuration such as a corotron, a scorotron, and a solid state charger. Among these charging systems, particularly, a contact charging system or a contactless proximal disposing system is more preferable and has advantages that a charging efficiency is high, ozone emissions are low, and the apparatus can be downsized.

The developing device 5 is a developing unit configured to develop the electrostatic latent image formed over the surface of the photoconductor 3 to form a toner image. The developing device 5 includes a developing roller 51 as a developer bearer.

A developing bias voltage is applied to the developing roller 51 from an unillustrated power source. A developer is contained in the casing of the developing device 5. A supplying screw 52 and a stirring screw 53 that are configured to stir the developer while conveying the developer in opposite directions to each other are provided in the casing of the developing device 5. A doctor 54 configured to regulate the developer borne over the developing roller 51 is also provided. A toner contained in the developer stirred and conveyed by the two screws including the supplying screw 52 and the stirring screw 53 is charged to a predetermined polarity. The developer is uplifted to the surface of the developing roller 51, is regulated by the doctor 54, and has the toner attached to the electrostatic latent image formed over the surface of the photoconductor 3 at a developing region at which the developing roller faces the photoconductor 3, to develop the electrostatic latent image to a toner image.

The primary transfer roller 7 is a primary transfer member included in a primary transfer device as a primary transfer unit configured to transfer the toner image over the surface of the photoconductor 3 to the intermediate transfer belt 14.

The cleaning device 6 is a cleaning unit configured to clean any residues such as the toner remaining over the surface of the photoconductor 3 after the toner image is transferred to the intermediate transfer belt 14. The cleaning device 6 includes a cleaning blade 62 and further includes other constituting members as needed.

Figure 3:
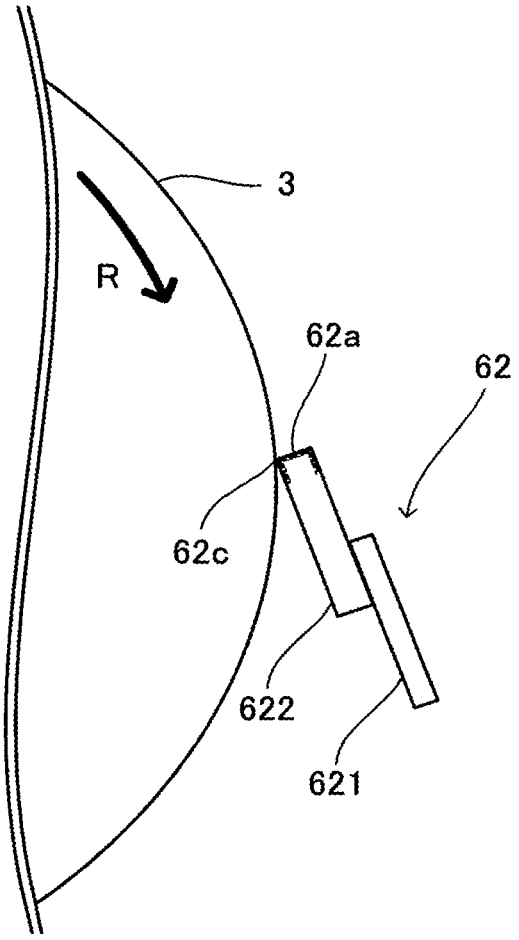
FIG. 3 is a depictive view illustrating a state that a cleaning blade of the present invention contacts a surface of an image bearer.

As illustrated in FIG. 3, the cleaning blade 62 contacts the photoconductor 3 in a counter direction with respect to the rotation direction of the photoconductor 3. The cleaning blade 62 includes a flat-plate-shaped supporting member 621 made of a stiff material such as a metal and a hard plastic and a flat-plate-shaped elastic member 622. The elastic member 622 is secured to one end of the supporting member 621 with an adhesive or the like. Another end of the supporting member 621 is cantilevered to the case of the cleaning device 6. The details of the cleaning blade 62 will be described below.

The lubricant applying device 10 is a lubricant applying unit configured to apply a lubricant over a surface of the photoconductor 3 after cleaning by the cleaning device 6.

The lubricant applying device 10 includes a fur brush 101, a solid lubricant 103, a lubricant pressurizing spring 103*a*, and a bracket 103*b*.

The solid lubricant 103 is biased by the lubricant pressurizing spring 103*a* in a direction toward the fur brush 101 while being supported on the bracket 103*b*.

The fur brush 101 is an applying brush for applying the solid lubricant 103 over the surface of the photoconductor 3 and is configured to rotate in a following direction with respect to the rotation direction of the photoconductor 3 to scrape the solid lubricant 103 and apply the lubricant over the surface of the photoconductor 3. By application of the lubricant over the photoconductor 3 by the fur brush 101, the friction coefficient over the surface of the photoconductor 3 is maintained at 0.2 or lower during a period for which no image is formed The unillustrated charge eliminating lamp is a charge eliminating unit configured to eliminate charges from the surface of the photoconductor 3 after cleaning.

In terms of improving an image quality, the toner used in the image forming apparatus 500 described above is preferably a polymerization toner produced by a suspension polymerization method, an emulsion polymerization method, or a dispersion polymerization method because these methods make it easy to impart a high circularity and a small particle diameter to the toner. Among these methods, a polymerization toner having an average circularity of greater than or equal to 0.97 and a volume average particle diameter of less than or equal to 5.5 μm is preferable in terms of forming an image having a high resolution.

Next, an image forming operation of the image forming apparatus 500 will be described with reference to FIG. 1 and FIG. 2.

First, upon reception of a signal indicating execution of printing from an unillustrated operation unit or the like, predetermined voltages or currents are sequentially applied to the charging roller 4 and the developing roller 51 respectively at predetermined timings. Likewise, predetermined voltages or currents are sequentially applied to the light sources of the optical writing unit 40, the charge eliminating lamp, etc. at predetermined timings. In synchronization with this application, the photoconductor 3 is driven to rotate in the direction of an arrow in FIG. 2 by an unillustrated photoconductor driving motor which is a driving unit.

Upon the photoconductor 3 being driven in the rotation direction indicated by the arrow R in FIG. 2, first, the charging roller 4 uniformly charges the surface of the photoconductor 3 to a predetermined electric potential. Then, the optical writing unit 40 irradiates the surface of the photoconductor 3 with laser light L corresponding to image information, to eliminate charges from portions of the surface of the photoconductor 3 irradiated with the laser light L to form an electrostatic latent image.

The surface of the photoconductor 3 over which the electrostatic latent image is formed is rubbed in a sliding manner by a magnetic brush of the developer formed over the surface of the developing roller 51 at a region at which the photoconductor 3 faces the developing device 5. At the time, a negatively-charged toner over the surface of the developing roller 51 is transferred to the electrostatic latent image by the effect of a predetermined developing bias voltage applied to the developing roller 51. As a result, the electrostatic latent image is developed to a toner image.

The same image forming process is performed in the image forming units 1, to form the toner images of the colors over the surfaces of the photoconductors 3Y, 3C, 3M, and 3K of the image forming units 1Y, 1C, 1M, and 1K.

As described above, in the image forming apparatus 500, the developing device 5 reversely develops the electrostatic latent image formed over the surface of the photoconductor 3 with a toner charged to the negative polarity. The present embodiment has been described about an example using a contactless charging roller system of an N/P (negative/positive) type configured to attach a toner to a portion under a lower electric potential. However, this is a non-limiting example.

The toner images of the colors formed over the surfaces of the photoconductors 3Y, 3C, 3M, and 3K are primarily transferred to the intermediate transfer belt 14 sequentially to be overlaid together over the surface of the intermediate transfer belt 14. As a result, the four-color toner image is formed over the surface of the intermediate transfer belt 14.

The four-color toner image formed over the intermediate transfer belt 14 is transferred onto a recording medium P fed from the first paper feeding cassette 151 or the second paper feeding cassette 152 to the secondary transfer nip through the rollers of the pair of registration rollers 55. At the time, the recording medium P once stops in the state of being nipped by the pair of registration rollers 55 and is fed to the secondary transfer nip in synchronization with the intermediate transfer belt 14 over which the four-color toner image is formed. The recording medium P having the transferred four-color toner image is separated from the intermediate transfer belt 14 and conveyed to the fixing unit 80. The fixing unit 80 to which the recording medium P has been conveyed fixes the four-color toner image over the recording medium P by the effect of heat and pressure. The recording medium P having the fixed four-color toner image is ejected to and mounted over the stacking portion 88 provided at the top of the image forming apparatus 500.

After the toner image has been transferred to the recording medium P at the secondary transfer nip, the surface of the intermediate transfer belt 14 has any toner remaining untransferred over the surface removed by the belt cleaning unit 162.

The surfaces of the photoconductors 3 from which the toner images of the colors have been transferred to the intermediate transfer belt 14 at the primary transfer nips, have any toner remaining after the transferring removed by the cleaning device 6, have the lubricant applied by the lubricant applying device 10, and have charges eliminated by the unillustrated charge eliminating lamp.

As illustrated in FIG. 2, the image forming units 1 of the image forming apparatus 500 have the photoconductor 3, the charging roller 4 as a process unit, the developing device 5, the cleaning device 6, the lubricant applying device 10, etc. housed within a frame 2. As process cartridges, the image forming units 1 are configured to be attachable to and detachable from the body of the image forming apparatus 500.

In the image forming apparatus 500, the image forming units 1 as the process cartridges are configured as an integrated body of the photoconductor 3 and the process unit. However, this is a non-limiting example and the image forming units 1 may be configured as an integrated body of the photoconductor 3, the charging roller 4, the developing device 5, the cleaning device 6, and the lubricant applying device 10.

Next, an example of the cleaning blade of the present invention will be described with reference to the drawings.

Figure 4:
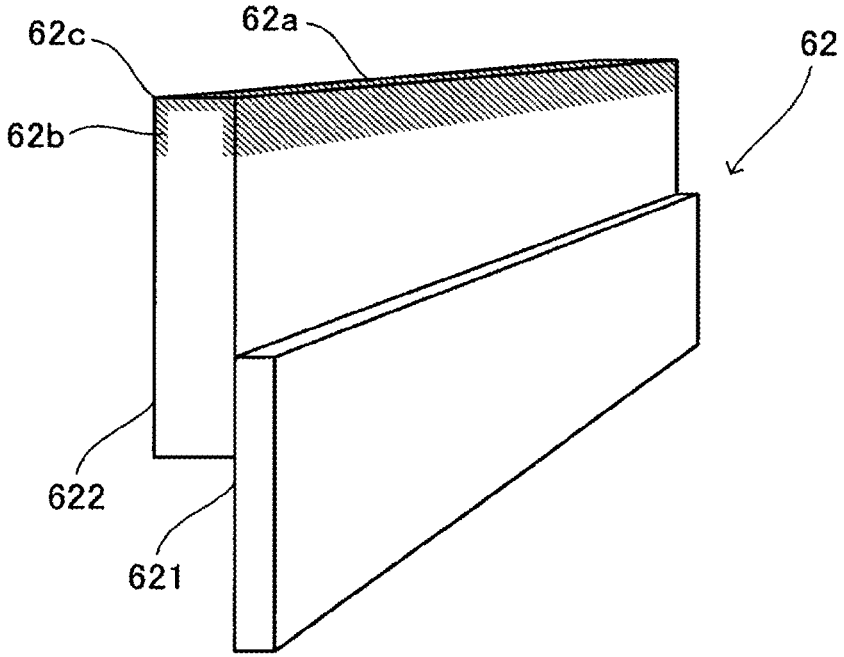
FIG. 4 is a perspective view illustrating a cleaning blade according to an embodiment of the present invention.

FIG. 4 is a perspective view illustrating a cleaning blade according to an embodiment of the present invention.

As illustrated in FIG. 4, a cleaning blade 62 includes a supporting member 621 and a flat-plate-shaped elastic member 622 having one end joined to the supporting member and having a free end having a predetermined length at another end. The cleaning blade 62 is disposed such that a contact part 62*c*, which is one end of the elastic member 622 at the free end side, contacts the surface of the photoconductor 3 along a longer direction.

It is preferable that the elastic member 622 be a member having a high impact resilience in order to be able to follow decentering of the photoconductor 3 or minute rolling over the surface of the photoconductor 3 and preferably a polyurethane rubber or the like. A JIS-A hardness of the elastic member is preferably greater than or equal to 65 degrees but less than or equal to 80 degrees. An impact resilience of the elastic member based on a JIS K6255 standard is preferably lower than or equal to 75% at 23° C.

The contact part 62*c* of the elastic member 622 to contact the surface of the image bearer contains a cured product of the curable composition containing a (meth)acrylate compound having an alicyclic structure containing 6 or more carbon atoms in a molecule. Among such (meth)acrylate compounds having an alicyclic structure containing 6 or more carbon atoms in a molecule, a (meth)acrylate compound having a tricyclodecane structure or a (meth)acrylate compound having an adamantane structure is preferable.

If a typical cleaning blade made of only a rubber is used for a spherical toner that is used for obtaining a higher image quality, the spherical toner may proceed into a slight gap between the cleaning blade and a photoconductor drum which is the image bearer and eventually slip through the gap, leading to a cleaning failure.

In order to prevent slip-through of the toner, there is a need of providing a high contact pressure between the photoconductor drum and the cleaning blade to improve the cleaning performance.

Figure 5A:
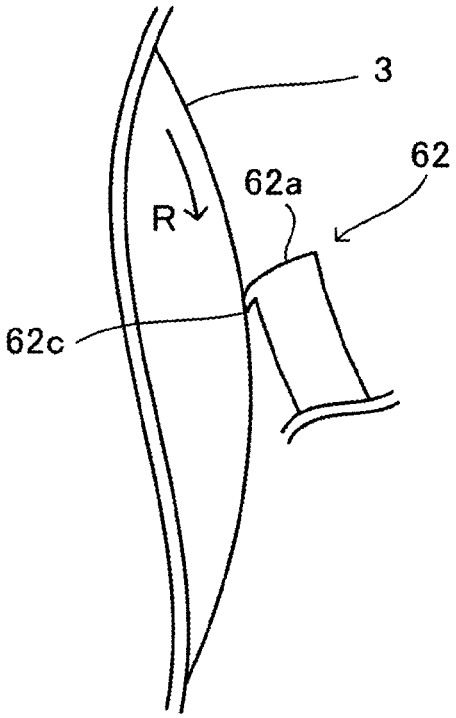
FIG. 5A is a depictive diagram illustrating a state that a contact part of an elastic member has curled.

However, when the cleaning blade is provided with a high contact pressure (linear pressure) with respect to the photoconductor drum, a high frictional force develops between the photoconductor drum and the cleaning blade. As a result, as illustrated in FIG. 5A, the cleaning blade 62 is drawn in the rotation direction of the photoconductor drum 21 to cause the contact part 62*c* of the cleaning blade 62 to curl. When the curled cleaning blade 62 restores to the original shape against the curling, an abnormal noise may occur.

Figure 5B:
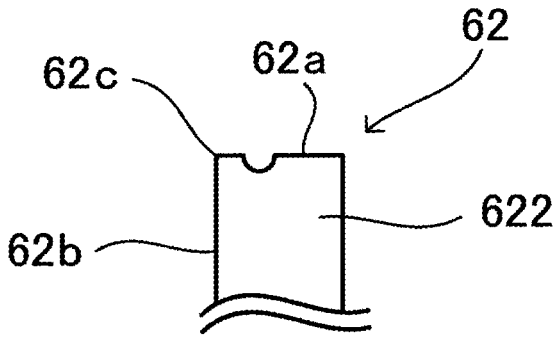
FIG. 5B is a depictive diagram illustrating a state that a local wear has occurred in an elastic member.

When the cleaning blade 62 continues cleaning with the contact part 62*c* curling up, a local wear occurs in the leading end surface 62*a* of the cleaning blade 62 as illustrated in FIG. 5B.

Figure 5C:
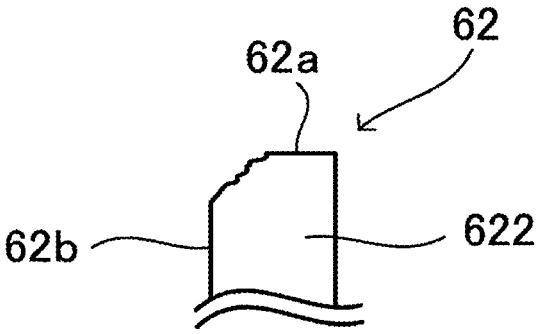
FIG. 5C is a depictive diagram illustrating a state that an elastic member has cracked.

When cleaning is further continued in this state, the local wear becomes severe to finally crack the contact part 62*c* as illustrated in FIG. 5C. When the contact part 62*c* is cracked, there is a problem that the toner cannot be cleaned normally to cause a cleaning failure. The cleaning blade of the present invention overcomes this problem.

Figure 6:
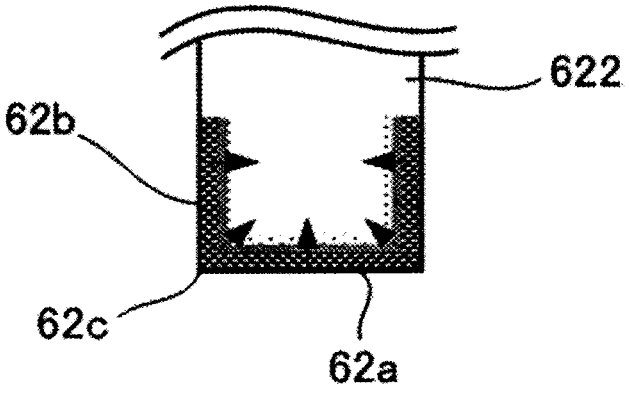
FIG. 6 is an enlarged view of a contact part of a cleaning blade of the present invention and adjacent parts of the contact part.

FIG. 6 is an enlarged view of the contact part of the cleaning blade of the present invention and adjacent parts of the contact part.

As illustrated in FIG. 6, a structure containing a cured product of the curable composition in an impregnated portion 62*b* is obtained by impregnating the contact part 62*c* of the elastic member 622 with the curable composition containing a (meth)acrylate compound having an alicyclic structure containing 6 or more carbon atoms in a molecule and irradiating the contact part 62*c* with ultraviolet rays. This provides the contact part 62*c* with a high hardness and makes it possible to improve durability and suppress curling of the elastic member 622 deforming in the rotation direction of the photoconductor 3. Further, even when the contact part 62*c* of the elastic member 622 wears over time, the elastic member 622 can be suppressed from deformation because the contact part 62*c* has the structure containing the cured product of the curable composition in the impregnated portion 62*b*.

EXAMPLES

Examples of the present invention will be described below. However, the present invention is not limited to these Examples by any means.

(Production Examples 1 to 11 for Producing Elastic Member)

In Production Examples 1 to 11 for producing an elastic member, elastic members having a size of 11.5 mm×326 mm and a thickness of 1.8 mm were produced based on the compositions and blending amounts presented in Table 1 and Table 2 according to a centrifugal casting method.

Next, a JIS-A hardness, an impact resilience, and a spin-spin relaxation time ($T_2$) of each of the elastic members produced were measured in the manners described below. The results are presented in Table 1 and Table 2.

<JIS-A Hardness>

A JIS-A hardness of each of the elastic members was measured according to a JIS K6253 standard with a micro rubber hardness meter (product name: MD-1 available from Kobunshi Keiki Co., Ltd.).

<Impact Resilience>

An impact resilience of each of the elastic members was measured according to a JIS K6255 standard with a tripso-type impact resilience tester (product name: RESILIENCE TESTER available from Toyo Seiki Seisaku-Sho, Ltd.) under measuring conditions of 23° C.

<Spin-Spin Relaxation Time ($T_2$)>

The spin-spin relaxation time ($T_2$) of each of the elastic members was measured according to a solid echo method in a pulse NMR analysis.

A decay curve of an observed nucleus 1H was measured with "MINISPEC-MQ20" available from Bruker Optics K.K. according to a solid echo method. The elastic member was cut into a sample having a size of 8 mm×8 mm×1.8 mm, and the sample was put in a dedicated sample tube. The sample tube was inserted into an appropriate range of a magnetic field, and the measurement was performed under the conditions described below.

[Detailed Measuring Conditions]

First Duration: 0.01 msec

Last Duration: 5.0 msec

Data Point: 20

Cumulated Number: 32

Temperature: 40° C.

TABLE 1

| | Production Examples for producing elastic member | | | | | |
|---|---|---|---|---|---|---|
| | 1 | 2 | 3 | 4 | 5 | 6 |
| Elastic member No. | Elastic member 1 | Elastic member 2 | Elastic member 3 | Elastic member 4 | Elastic member 5 | Elastic member 6 |
| PCL220 | 100 parts by mass | 100 parts by mass | 100 parts by mass | 100 parts by mass | 100 parts by mass | 100 parts by mass |
| MD1 | 34 parts by mass | 30 parts by mass | 34 parts by mass | 26 parts by mass | 26 parts by mass | 32 parts by mass |
| 1,4-BD/TMP | 7.5 | 2.6 | 2.3 | 7.5 | 2.3 | 4.2 |
| α value | 0.98 | 0.98 | 0.98 | 0.98 | 0.98 | 0.98 |
| JIS-A hardness (degree) | 65.5 | 63.0 | 66.0 | 62.5 | 65.0 | 64.0 |
| Impact resilience (%) | 68.0 | 70.0 | 30.0 | 78.5 | 62.0 | 67.0 |
| Spin-spin relaxation time ($T_2$) (msec) | 0.65 | 0.74 | 0.60 | 0.94 | 0.90 | 0.82 |

TABLE 2

| | Production Examples for producing elastic member | | | | |
|---|---|---|---|---|---|
| | 7 | 8 | 9 | 10 | 11 |
| Elastic member No. | Elastic member 7 | Elastic member 8 | Elastic member 9 | Elastic member 10 | Elastic member 11 |
| PCL220 | 100 parts by mass | 100 parts by mass | 100 parts by mass | 100 parts by mass | 100 parts by mass |
| MDI | 32 parts by mass | 43 parts by mass | 40 parts by mass | 44 parts by mass | 22 parts by mass |
| 1,4-BD/TMP | 2.4 | 2.3 | 4.0 | 4.2 | 8.0 |
| α value | 0.98 | 0.98 | 0.98 | 0.98 | 0.98 |
| JIS-A hardness (degree) | 67.0 | 68.0 | 70.0 | 72.0 | 60.5 |
| Impact resilience (%) | 58.0 | 30.0 | 52.0 | 48.0 | 76.0 |
| Spin-spin relaxation time ($T_2$) (msec) | 0.65 | 0.41 | 0.52 | 0.43 | 1.10 |

The details of the descriptions in Table 1 and Table 2 are as follows.

Polycaprolactone (PCL220 available from Daicel Corporation)

4,4'-Methylenediphenyldiisocyanate (MDI available from Kanto Chemical Co., Inc.)

1,4-Butanediol (1,4-BD available from Kanto Chemical Co., Inc.)

Trimethylolpropane (TMP available from Kanto Chemical Co., Inc.

1,4-BD/TMP indicates a mass ratio between 1,4-butanediol and trimethylolpropane.

α Value indicates a mole ratio of a hydroxyl group to an isocyanate group.

(Preparation Example 1 for Preparing Ultraviolet-Curable Composition)

An ultraviolet-curable composition 1 was prepared based on the composition described below according to a usual method.

[Composition]

Trimethylolpropane triacrylate represented by a structural formula below (TMPTA available from Daicel-Cytec Company, Ltd., with 3 functional groups and a molecular weight of 296)-80 parts by mass $$CH_3—CH_2C(CH_2OOC—CH{=}CH_2)_3$$

Polymerization initiator (IRGACURE 184 available from BASF Japan Ltd.)—1.6 parts by mass Solvent (cyclohexanone)—20 parts by mass (Preparation Example 2 for Preparing Ultraviolet-Curable Composition)

An ultraviolet-curable composition 2 was prepared based on the composition described below according to a usual method.

[Composition]

Tricyclodecanedimethanol diacrylate represented by a structural formula below (product name: A-DCP available from Shin-Nakamura Chemical Co., Ltd., with 2 functional groups and a molecular weight of 304)-80 parts by mass

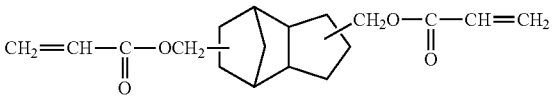

Polymerization initiator (IRGACURE 184 available from BASF Japan Ltd.)—1.6 parts by mass Solvent (cyclohexanone)—20 parts by mass (Preparation Example 3 for Preparing Ultraviolet-Curable Composition)

An ultraviolet-curable composition 3 was prepared based on the composition described below according to a usual method.

[Composition]

A-DCP mentioned above—50 parts by mass

Pentaerythritol triacrylate represented by a structural formula below (product name: PETIA available from Daicel-Cytec Company, Ltd., with 3 functional groups and a molecular weight of 298)-30 parts by mass

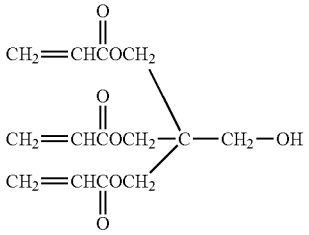

Polymerization initiator (IRGACURE 184 available from BASF Japan Ltd.)—1.6 parts by mass Solvent (cyclohexanone)—20 parts by mass (Preparation Example 4 for Preparing Ultraviolet-Curable Composition)

An ultraviolet-curable composition 4 was prepared based on the composition described below according to a usual method.

[Composition]

Perfluoro-1,3-adamantanediol dimethacrylate represented by a structural formula below (product name: ADAMANTATE X-F-203 available from Idemitsu Kosan Co., Ltd., with 2 functional groups and a molecular weight of 616)—50 parts by mass

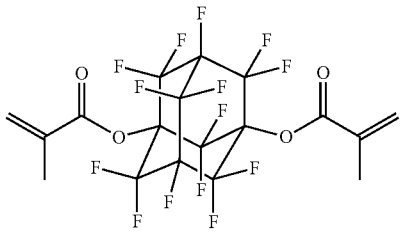

PETIA mentioned above—30 parts by mass

Polymerization initiator (IRGACURE 184 available from BASF Japan Ltd.)—1.6 parts by mass Solvent (cyclohexanone)—20 parts by mass (Preparation Example 5 for Preparing Ultraviolet-Curable Composition)

An ultraviolet-curable composition 5 was prepared based on the composition described below according to a usual method.

[Composition]

1,3,5-Adamantanetrimethanol trimethacrylate represented by a structural formula below (product name: DIAPUREST ADTM available from Mitsubishi Gas Chemical Company, Inc., with 3 functional groups and a molecular weight of 372)—80 parts by mass

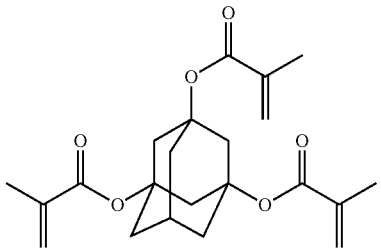

Polymerization initiator (IRGACURE 184 available from BASF Japan Ltd.)—1.6 parts by mass Solvent (cyclohexanone)—20 parts by mass (Preparation Example 6 for Preparing Ultraviolet-Curable Composition)

An ultraviolet-curable composition 6 was prepared based on the composition described below according to a usual method.

[Composition]

Fluorine-based (meth)acrylate compound (product name: VISCOAT V-3F available from Osaka Organic Chemical Industry Ltd., with a molecular weight of 154)—50 parts by mass A-DCP mentioned above—30 parts by mass Polymerization initiator (IRGACURE 184 available from BASF Japan Ltd.)—1.6 parts by mass Solvent (cyclohexanone)—20 parts by mass Example 1

Production of Cleaning Blade

An impregnation treatment was performed by immersing the elastic member 1 in the ultraviolet-curable composition 1. Specifically, a portion of the elastic member 1 extending until 2 mm from an end surface at which the contact part to contact a photoconductor was present was impregnated for 5 minutes with a liquid obtained by diluting the ultraviolet-curable composition 1 with a diluent (cyclohexanone) such that a solid content concentration of the ultraviolet-curable composition would be 80% by mass, and then air-dried for 3 minutes. After the air drying, the resultant was passed through a belt conveyor-type ultraviolet irradiator (product name: ECS-1511U available from Eye Graphic Co., Ltd.) configured to irradiate an irradiation target with ultraviolet rays while passing the irradiation target through a light source set inside the irradiator, at a power output of the light source of 176 W/cm, at a conveyor speed of 0.8 m/min, and at a number of times the irradiation target was passed through the belt conveyor-type ultraviolet irradiator of 5 passes (5 passages).

Next, the resultant was dried with a thermal dryer at an internal temperature of the dryer of 100° C. for 15 minutes.

After a curing treatment, the resultant was secured with an adhesive to a sheet metal holder which was the supporting member, to produce a cleaning blade.

Example 2

Production of Cleaning Blade

A cleaning blade was produced in the same manner as in Example 1 except that the impregnation time of Example 1 was changed to 15 minutes and the elastic member 1 used in Example 1 was changed to the elastic member 2.

Example 3

Production of Cleaning Blade

A cleaning blade was produced in the same manner as in Example 1 except that the ultraviolet-curable composition 1 used in Example 1 was changed to the ultraviolet-curable composition 2, the elastic member 1 used in Example 1 was changed to the elastic member 3, and the impregnation time of Example 1 was changed to 15 minutes.

Example 4

Production of Cleaning Blade

A cleaning blade was produced in the same manner as in Example 3 except that the elastic member 3 used in Example 3 was changed to the elastic member 4 and the impregnation time of Example 3 was changed to 25 minutes.

Example 5

Production of Cleaning Blade

A cleaning blade was produced in the same manner as in Example 4 except that the ultraviolet-curable composition 2 used in Example 4 was changed to the ultraviolet-curable composition 3 and the elastic member 4 used in Example 4 was changed to the elastic member 5.

Example 6

Production of Cleaning Blade

A cleaning blade was produced in the same manner as in Example 2 except that the ultraviolet-curable composition 1 used in Example 2 was changed to the ultraviolet-curable composition 4 and the impregnation time of Example 2 was changed to 10 minutes.

Example 7

Production of Cleaning Blade

A cleaning blade was produced in the same manner as in Example 6 except that the elastic member 2 used in Example 6 was changed to the elastic member 6 and the impregnation time of Example 6 was changed from 10 minutes to 30 minutes.

Example 8

Production of Cleaning Blade

A cleaning blade was produced in the same manner as in Example 3 except that the elastic member 3 used in Example 3 was changed to the elastic member 7 and the ultraviolet-curable composition 2 used in Example 3 was changed to the ultraviolet-curable composition 5.

Example 9

Production of Cleaning Blade

A cleaning blade was produced in the same manner as in Example 1 except that the ultraviolet-curable composition 1 used in Example 1 was changed to the ultraviolet-curable composition 6, the elastic member 1 used in Example 1 was changed to the elastic member 3, and the impregnation time of Example 1 was changed to 15 minutes.

Comparative Example 1

Production of Cleaning Blade

A cleaning blade was produced in the same manner as in Example 1 except that the elastic member 1 used in Example 1 was changed to the elastic member 8.

Comparative Example 2

Production of Cleaning Blade

A cleaning blade was produced in the same manner as in Comparative Example 1 except that the impregnation time of Comparative Example 1 was changed to 120 minutes.

Comparative Example 3

Production of Cleaning Blade

A cleaning blade was produced in the same manner as in Example 3 except that the elastic member 3 used in Example 3 was changed to the elastic member 9 and the impregnation time of Example 3 was changed to 80 minutes.

Comparative Example 4

Production of Cleaning Blade

A cleaning blade was produced in the same manner as in Example 5 except that the elastic member 5 used in Example 5 was changed to the elastic member 10 and the impregnation time of Example 5 was changed to 120 minutes.

Comparative Example 5

Production of Cleaning Blade

A cleaning blade was produced in the same manner as in Example 6 except that the elastic member 2 used in Example 6 was changed to the elastic member 11 and the impregnation time of Example 6 was changed to 15 minutes.

Comparative Example 6

Production of Cleaning Blade

A cleaning blade was produced in the same manner as in Example 4 except that the impregnation treatment was not performed unlike in Example 4.

Next, each cleaning blade produced was evaluated in terms of a Martens hardness of the elastic member, an amount of curling of the contact part, and rolling of the contact part in the manners described below. The results are presented in Table 3 and Table 4.

<Martens Hardness of Elastic Member>

The Martens hardness of the elastic member was measured with a microhardness meter HM-2000 available from Fischer Instruments K.K. by indenting a Vickers indenter in 10 seconds such that the maximum load would be 1.0 mN, maintaining the Vickers indenter there for 5 seconds, and removing the force of 1.0 mN in 10 seconds. The measurement was performed using a jig that made the plate surfaces of the elastic member horizontal. The measurement was performed at positions that were on a plate surface of the elastic member and were reached by proceeding by 20 μm and 100 μm respectively from the edge of the contact part in a direction toward a portion of the contact part facing the edge.

<Amount of Curling of Contact Part>

An amount of curing of the contact part was measured in the manner described below.

First, a curable composition containing polycarbonate, which was used in a surface layer of the image bearer, was applied over a plate surface of a glass plate (with dimensions of 150 mm×110 mm and an average thickness of 4 mm, surface treatment: an ITO film treatment) and cured. The cleaning blade was secured to the glass plate at a linear pressure of 20 N/m at a cleaning angle of 67.5°.

The cleaning angle refers to an angle formed between a tangent line over a cleaning target member at a position at which the contact part of the elastic member contacts the cleaning target member and the end surface of the elastic member at the free end.

Next, the glass plate was slid at an equivalent linear velocity to a linear velocity of the image bearer in the rotation direction of the image bearer in a color copier, to observe the contact condition of the contact part from the back side of the glass plate with a CCD camera (product name: CM-5 available from Nikon Corporation) and output an image representing the contact condition. Based on the output image, a length by which the contact part contacted the glass plate in the sliding direction was measured as an amount of curling of the contact part. The amount of curling of the contact part was evaluated according to the criteria below.

[Evaluation Criteria]

A: No curling.

B: The amount of curling was less than 5 μm.

C: The amount of curling was greater than or equal to 5 μm.

<Rolling of Contact Part>

Rolling of the contact part was measured according to JIS B 0601 (2001) with SURFCOM 1400D available from Tokyo Seimitsu Co., Ltd. and evaluated according to the criteria below. Note that a measurement length was set to 40 mm, a cut-off value λc was set to 0.8 mm, and λf was set to 8 mm.

[Evaluation Criteria]

A: Rolling of the contact part was less than or equal to 2 μm.

C: Rolling of the contact part was greater than 2 μm.

Next, each cleaning blade produced was mounted on a color multifunction peripheral (product name: IMAGIO MP C5001 available from Ricoh Co., Ltd.) at a linear pressure of 20 N/m at a cleaning angle of 67.5°.

With the color multifunction peripheral (product name: IMAGIO MP C5001 available from Ricoh Co. Ltd.) that was loaded with a toner described below, a chart (with a horizontally-long A4 size) having an image occupation rate of 5% was output on 10,000 sheets and on 50,000 sheets at 3 prints/job under conditions of 21° C. and 65% RH. After this outputting, an amount of wear of the elastic member of the cleaning blade, slip-through of the toner, and a cleaning property were evaluated in the manners described below. The results are presented in Table 3 and Table 4.

—Toner—

Product developed by Ricoh Co., Ltd.

Producing method: polymerization method

Average circularity: 0.98

Volume average particle diameter: 4.9 μm

<Amount of Wear of Elastic Member>

After the outputting on 50,000 sheets, a cross-sectional area of wear of the contact part of the elastic member of the cleaning blade was measured with a laser microscope VK-9510 available from Keyence Corporation.

<Slip-Through of Toner>

After the outputting on 10,000 sheets and after the outputting on 50,000 sheets, a tape (PRINTAC available from Nitto Denko Corporation) was pasted over the surface of the photoconductor immediately after cleaned with each cleaning blade. After the tape was peeled, it was observed and evaluated according to the criteria below whether the toner, etc. were present over the tape.

[Evaluation Criteria]

A: There were no toner, etc. after the outputting on 50,000 sheets.

B: There were no toner, etc. after the outputting on 10,000 sheets, but there were the toner, etc. after the outputting on 50,000 sheets.

C: There were the toner, etc. after the outputting on 10,000 sheets.

<Cleaning Property>

After the outputting on 50,000 sheets, an image for evaluation (with a horizontally-long A4 size) representing a chart including three vertical band patterns (with respect to a sheet advancing direction) having a width of 43 mm was output on 20 sheets. Then, an image that was output on the 21$^{st}$ sheet was visually observed, and a cleaning property was evaluated according to the criteria below based on whether an abnormal image was present or absent. The abnormal image refers to an image appearing in a printed image as a streak or band shape or a white spot image.

[Evaluation Criteria]

A: There was no abnormal image.

C: There was an abnormal image.

TABLE 3

| | Elastic member No. | Ultraviolet-curable composition No. | Impregnation time (min) | Spin-spin relaxation time ($T_2$) (msec) | Martens hardness ($N/mm^2$) Position at 20 μm from contact part | Martens hardness ($N/mm^2$) Position at 100 μm from contact part |
|---|---|---|---|---|---|---|
| Ex. 1 | 1 | 1 | 5 | 0.65 | 1.8 | 1.2 |
| Ex. 2 | 2 | 1 | 15 | 0.74 | 4.0 | 1.7 |
| Ex. 3 | 3 | 2 | 15 | 0.60 | 3.8 | 1.9 |
| Ex. 4 | 4 | 2 | 25 | 0.94 | 6.0 | 1.9 |
| Ex. 5 | 5 | 3 | 25 | 0.90 | 5.0 | 1.8 |
| Ex. 6 | 2 | 4 | 10 | 0.74 | 2.2 | 1.7 |
| Ex. 7 | 6 | 4 | 30 | 0.82 | 9.5 | 2.0 |
| Ex. 8 | 7 | 5 | 15 | 0.65 | 5.0 | 1.6 |
| Ex. 9 | 3 | 6 | 15 | 0.60 | 4.0 | 2.6 |
| Comp. Ex. 1 | 8 | 1 | 5 | 0.41 | 4.2 | 1.2 |
| Comp. Ex. 2 | 8 | 1 | 120 | 0.41 | 11.0 | 2.2 |
| Comp. Ex. 3 | 9 | 2 | 80 | 0.52 | 9.0 | 1.2 |
| Comp. Ex. 4 | 10 | 3 | 120 | 0.43 | 11.0 | 2.0 |
| Comp. Ex. 5 | 11 | 4 | 15 | 1.10 | 2.0 | 1.8 |
| Comp. Ex. 6 | 4 | None | None | 0.94 | 0.7 | 0.8 |

TABLE 4

| | Contact part: Amount of curling | Contact part: rolling | Amount of wear of elastic member ($\mu m^2$) | Slip through of toner | Cleaning property |
|---|---|---|---|---|---|
| Ex. 1 | B | A | 30 | B | A |
| Ex. 2 | A | A | 31 | B | A |
| Ex. 3 | A | A | 27 | A | A |
| Ex. 4 | A | A | 20 | A | A |
| Ex. 5 | A | A | 15 | A | A |
| Ex. 6 | A | A | 6 | A | A |
| Ex. 7 | A | A | 7 | A | A |
| Ex. 8 | A | A | 20 | A | A |
| Ex. 9 | A | A | 10 | A | A |
| Comp. Ex. 1 | B | A | — | C | C |
| Comp. Ex. 2 | A | C | — | B | C |
| Comp. Ex. 3 | A | C | — | B | C |
| Comp. Ex. 4 | A | C | — | C | C |

TABLE 4-continued

| | Contact part: Amount of curling | Contact part: rolling | Amount of wear of elastic member ($\mu m^2$) | Slip through of toner | Cleaning property |
|---|---|---|---|---|---|
| Comp. Ex. 5 | C | A | — | B | C |
| Comp. Ex. 6 | C | C | — | C | C |

In Table 4, the sign "-" in the amount of wear of the elastic member of Comparative Examples 1 to 6 means that measurement of the amount of wear was not conducted because a cleaning failure had occurred.

From the results presented in Table 3 and Table 4, it turned out to be possible to obtain a long-life cleaning blade capable of maintaining favorable images for a long term by making a cured product of a predetermined curable composition be contained in a contact part of an elastic member of which spin-spin relaxation time ($T_2$) measured by pulse NMR was longer than or equal to 0.6 msec but shorter than or equal to 1.0 msec.

Aspects of the present invention are as follows, for example.

<1> A cleaning blade including an elastic member, wherein a spin-spin relaxation time ($T_2$) of the elastic member obtained by a solid echo method in a pulse NMR analysis is longer than or equal to 0.60 msec but shorter than or equal to 1.0 msec, and wherein the elastic member has a contact part to contact a surface of a cleaning target member, and the contact part contains a cured product of a curable composition.

<2> The cleaning blade according to <1>, wherein a Martens hardness at a position that is on a plate surface of the elastic member having a flat plate shape and is reached by proceeding by 20 μm from an edge of the contact part in a direction toward a portion of the contact part facing the edge is greater than or equal to 2 $N/mm^2$ but less than or equal to 10 $N/mm^2$, and wherein a Martens hardness at a position reached by proceeding by 100 μm from the edge of the contact part in the direction toward the portion of the contact part facing the edge is greater than or equal to 1.5 $N/mm^2$.

<3> The cleaning blade according to <1> or <2>,
wherein the elastic member has a JIS-A hardness of greater than or equal to 60 degrees and an impact resilience at 23° C. of lower than or equal to 80%.

<4> The cleaning blade according to any one of <1> to <3>,
wherein the curable composition is an ultraviolet-curable composition.

<5> The cleaning blade according to any one of <1> to <4>,
wherein the curable composition contains a (meth)acrylate compound having an alicyclic structure containing 6 or more carbon atoms in a molecule.

<6> The cleaning blade according to any one of <1> to <5>,
wherein the curable composition contains at least one selected from the group consisting of (meth)acrylate compounds each having a tricyclodecane structure and (meth) acrylate compounds each having an adamantane structure.

<7> The cleaning blade according to any one of <1> to <6>,
wherein the curable composition further contains a (meth) acrylate compound having a pentaerythritol tri(meth)acrylate structure containing 3 or more but 6 or less functional groups.

<8> The cleaning blade according to any one of <1> to <7>,
wherein the curable composition contains a fluorine-group-containing compound.

<9> An image forming apparatus including:
an image bearer;
a charging unit configured to charge a surface of the image bearer;
an exposing unit configured to expose the surface of the image bearer charged to light to form an electrostatic latent image;
a developing unit configured to develop the electrostatic latent image to form a toner image;
a transfer unit configured to transfer the toner image to a recording medium;
a fixing unit configured to fix the toner image transferred to the recording medium; and
a cleaning unit configured to contact the image bearer and remove a toner remaining over the surface of the image bearer,
wherein the cleaning unit includes the cleaning blade according to any one of <1> to <8>.

<10> A process cartridge including:
an image bearer;
a cleaning unit configured to contact the image bearer and remove a toner remaining over a surface of the image bearer; and
at least one of a charging unit configured to charge the surface of the image bearer, an exposing unit configured to expose the surface of the image bearer charged to light to form an electrostatic latent image, a developing unit configured to develop the electrostatic latent image to form a toner image, and a transfer unit configured to transfer the toner image to a recording medium,
wherein the cleaning unit includes the cleaning blade according to any one of <1> to <8>.

<11> The cleaning blade according to any one of <1> to <8>,
wherein the elastic member contains a polyurethane rubber or a polyurethane elastomer.

<12> The cleaning blade according to any one of <1> to <8> and <11>,
wherein the (meth)acrylate compound having a tricyclodecane structure is tricyclodecanedimethanol diacrylate or tricyclodecanedimethanol dimethacrylate.

<13> The cleaning blade according to any one of <1> to <8>, <11>, and <12>,
wherein the (meth)acrylate compound having an adamantane structure is at least one selected from the group consisting of 1,3-adamantanedimethanol diacrylate, 1,3-adamantanedimethanol dimethacrylate, 1,3,5-adamantanetrimethanol methacrylate, 1,3,5-adamantanetrimethanol trimethacrylate, and perfluoro-1,3-adamantanediol dimethacrylate.

<14> The cleaning blade according to any one of <1> to <8> and <11> to <13>,
wherein the fluorine-group-containing compound is a fluorine-based (meth)acrylate compound.

<15> The cleaning blade according to any one of <1> to <8> and <11> to <14>,
wherein a content of the (meth)acrylate compound having an alicyclic structure containing 6 or more carbon atoms in a molecule is greater than or equal to 20% by mass but less than or equal to 100% by mass of a total amount of the curable composition.

<16> The cleaning blade according to any one of <1> to <8> and <11> to <15>,
wherein the curable composition further contains a (meth) acrylate compound having a molecular weight of greater than or equal to 100 but less than or equal to 1,500.

<17> The cleaning blade according to any one of <1> to <8> and <11> to <16>,
wherein the elastic member has an average thickness of greater than or equal to 1.0 mm but less than or equal to 3.0 mm.

<18> The cleaning blade according to any one of <1> to <8> and <11> to <17>,
wherein the cleaning target member is an image bearer.

<19> The cleaning blade according to any one of <1> to <8> and <11> to <18>,
wherein a time for which the contact part of the elastic member is impregnated with the curable composition is shorter than or equal to 60 minutes.

<20> The cleaning blade according to <19>,
wherein the time for which the contact part of the elastic member is impregnated with the curable composition is shorter than or equal to 30 minutes.

The cleaning blade according to any one of <1> to <8> and <11> to <20>, the image forming apparatus according to <9>, and the process cartridge according to <10> have an object to overcome the various problems of the related art described above and achieve an object described below. That is, the cleaning blade has an object to provide a cleaning blade suppressed in curling and rolling of a contact part of an elastic member of the cleaning blade, capable of preventing occurrence of an uneven contact with a cleaning target member, and capable of realizing a favorable cleaning performance for a long term.

What is claimed is:

1. A cleaning blade comprising
an elastic member,
wherein a spin-spin relaxation time ($T_2$) of the elastic member obtained by a solid echo method in a pulse NMR analysis is longer than or equal to 0.60 msec but shorter than or equal to 1.0 msec, and
wherein the elastic member comprises a contact part to contact a surface of a cleaning target member, and the contact part comprises a cured product of a curable composition.

2. The cleaning blade according to claim 1, wherein a Martens hardness at a position that is on a plate surface of the elastic member having a flat plate shape and is reached by proceeding by 20 μm from an edge of the contact part in a direction toward a portion of the contact part proximal to the edge is greater than or equal to 2 $N/mm^2$ but less than or equal to 10 $N/mm^2$, and wherein a Martens hardness at a position reached by proceeding by 100 μm from the edge of the contact part in the direction toward the portion of the contact part facing the edge is greater than or equal to 1.5 $N/mm^2$.

3. The cleaning blade according to claim 1, wherein the elastic member has a JIS-A hardness of greater than or equal to 60 degrees and an impact resilience at 23° C. of lower than or equal to 80%.

4. The cleaning blade according to claim 1, wherein the curable composition comprises an ultraviolet-curable composition.

5. The cleaning blade according to claim 1, wherein the curable composition comprises a (meth) acrylate compound that comprises an alicyclic structure comprising 6 or more carbon atoms in a molecule.

6. The cleaning blade according to claim 1, wherein the curable composition comprises at least one selected from the group consisting of (meth)acrylate compounds each comprising a tricyclodecane structure and (meth)acrylate compounds each comprising an adamantane structure.

7. The cleaning blade according to claim 1, wherein the curable composition further comprises a (meth)acrylate compound comprising a pentaerythritol tri(meth)acrylate structure, and the pentaerythritol tri(meth)acrylate structure comprises 3 or more but 6 or less functional groups.

8. The cleaning blade according to claim 1, wherein the curable composition comprises a compound comprising a fluorine group.

9. The cleaning blade according to claim 1, wherein the spin-spin relaxation time of the elastic member is from 0.65 to 0.9 msec.

10. The cleaning blade according to claim 1, wherein the elastic member has a JIS-A hardness of from 62.5° to 70°.

11. The cleaning blade according to claim 1, wherein the elastic member has an impact resilience of from 30% to 78.5%.

12. The cleaning blade according to claim 1, wherein the curable composition comprises a polyisocyanate compound, a polyol, a (meth)acrylate compound having an alicyclic structure, and a fluorine group-containing compound.

13. The cleaning blade according to claim 1, wherein the curable composition comprises a polycaprolactone, a diphenyl diisocyanate, a diol and a polyol.

14. The cleaning blade according to claim 1, wherein the elastic membrane is coated with a cured film of the curable composition.

15. The cleaning blade according to claim 1, wherein the curable composition comprises a compound of the following formula

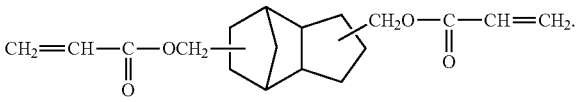

16. The cleaning blade according to claim 1, wherein the curable composition comprises a compound of the following formula

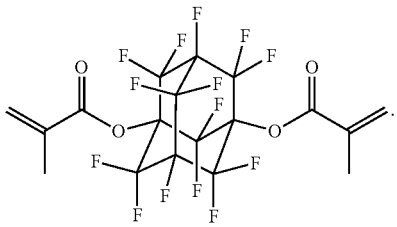

17. An image forming apparatus comprising:

an image bearer;

a charging unit configured to charge a surface of the image bearer;

an exposing unit configured to expose the charged surface of the image bearer to light to form an electrostatic latent image;

a developing unit configured to develop the electrostatic latent image to form a toner image;

a transfer unit configured to transfer the toner image to a recording medium;

a fixing unit configured to fix the toner image transferred to the recording medium; and a cleaning unit configured to contact the image bearer and remove a toner remaining over the surface of the image bearer, wherein the cleaning unit comprises a cleaning blade, wherein the cleaning blade comprises an elastic member, wherein a spin-spin relaxation time ($T_2$) of the elastic member obtained by a solid echo method in a pulse NMR analysis is longer than or equal to 0.60 msec but shorter than or equal to 1.0 msec, and wherein the elastic member comprises a contact part to contact a surface of a cleaning target member, and the contact part comprises a cured product of a curable composition.

18. A process cartridge comprising:

an image bearer;

a cleaning unit configured to contact the image bearer and remove a toner remaining over a surface of the image bearer; and at least one of a charging unit configured to charge the surface of the image bearer, an exposing unit configured to expose the surface of the charged image bearer to light to form an electrostatic latent image, a developing unit configured to develop the electrostatic latent image to form a toner image, and a transfer unit configured to transfer the toner image to a recording medium, wherein the cleaning unit comprises a cleaning blade, wherein the cleaning blade comprises an elastic member, wherein a spin-spin relaxation time ($T_2$) of the elastic member obtained by a solid echo method in a pulse NMR analysis is longer than or equal to 0.60 msec but shorter than or equal to 1.0 msec, and wherein the elastic member comprises a contact part to contact a surface of a cleaning target member, and the contact part comprises a cured product of a curable composition.

* * * * *